US005575206A

United States Patent [19]

Szyszko

[11] Patent Number: 5,575,206

[45] Date of Patent: Nov. 19, 1996

[54] SCREEN PRINTING APPARATUS WITH PALLET REGISTRATION

[75] Inventor: Alexander Szyszko, Bloomingdale, Ill.

[73] Assignee: Elexon Ltd., Elk Grove Village, Ill.

[21] Appl. No.: 547,895

[22] Filed: Oct. 25, 1995

[51] Int. Cl.[6] ..... B41F 15/10; B41F 15/26

[52] U.S. Cl. ..... 101/126

[58] Field of Search ..... 101/115, 126; 198/345.3

[56] References Cited

U.S. PATENT DOCUMENTS

| | | | |
|---|---|---|---|
| 3,795,189 | 3/1974 | Jaffa | 101/123 |
| 3,805,942 | 4/1974 | Auernhammer | 198/19 |
| 4,407,195 | 10/1983 | Jaffa | 101/123 |
| 4,735,139 | 4/1988 | Szarka | 101/126 |
| 4,819,559 | 4/1989 | Szarka | 101/474 |
| 4,909,146 | 3/1990 | Szarka | 101/126 |
| 5,503,068 | 4/1996 | Newman | 101/126 |

*Primary Examiner*—Ren Yan

*Attorney, Agent, or Firm*—Fitch, Even, Tabin & Flannery

[57] ABSTRACT

The screen printing press has pallet supports in the form of arms that carry movable pallets having substrates thereon between a plurality of printing stations to receive successive screen prints on the substrates. The pallet is shifted relative to the stationary support arm and is registered relative to a printing head at each of the print stations. Unlike conventional registration systems, where the support arm is shifted during registration as is the pallet which is fixed to the support arm, the pallet herein is releasably interlocked and is unlocked for shifting relative to the stationary support arm. When the pallet reaches a printing station, a movable pallet locator unlocks the pallet which is then free to float on the support arm. The movable locator shifts the floating pallet on the stationary support arm to engage a second locator, which is preferably fixed to the press frame and oppositely located from the movable locator. Preferably, the floating pallet is free to shift in and out, and left to right, as it registers between the opposed locators. After printing, the movable locator retracts and an actuator such as a spring causes the pallet to interlock again with its pallet support arm for travel to the next printing station.

8 Claims, 33 Drawing Sheets

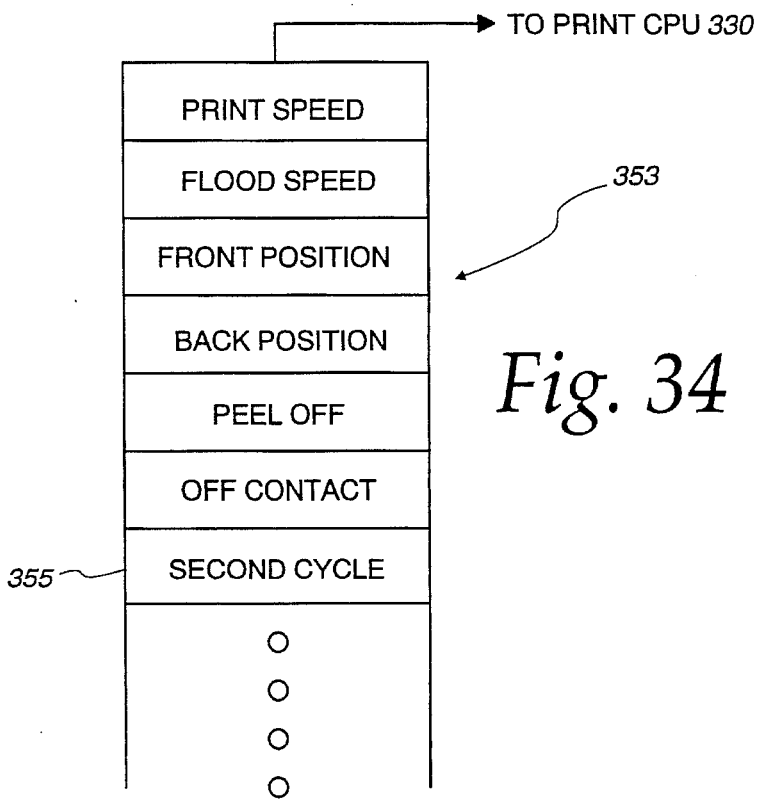
Fig. 34
Fig. 36
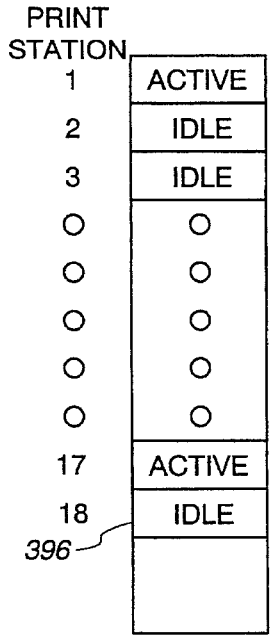
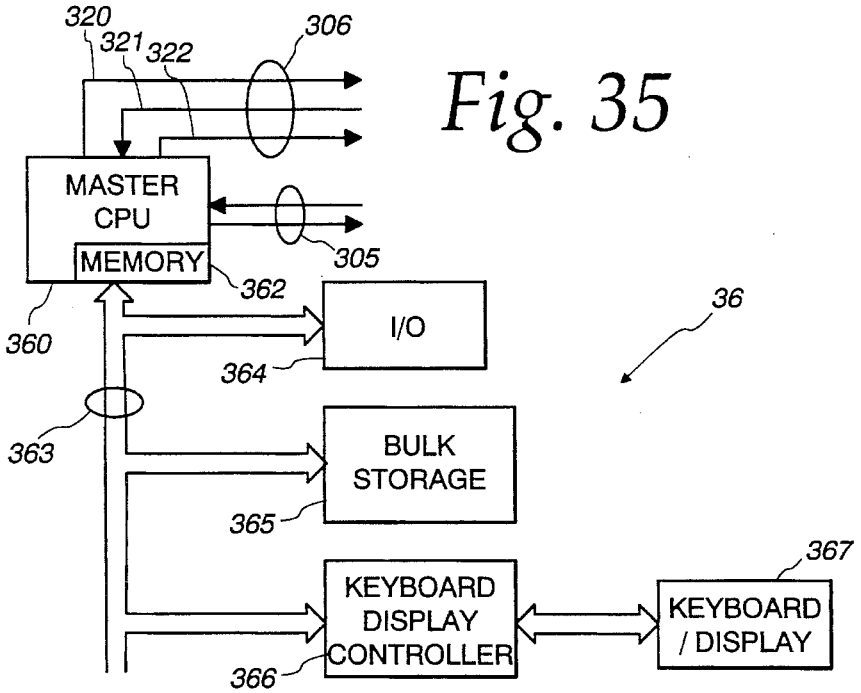
Fig. 35

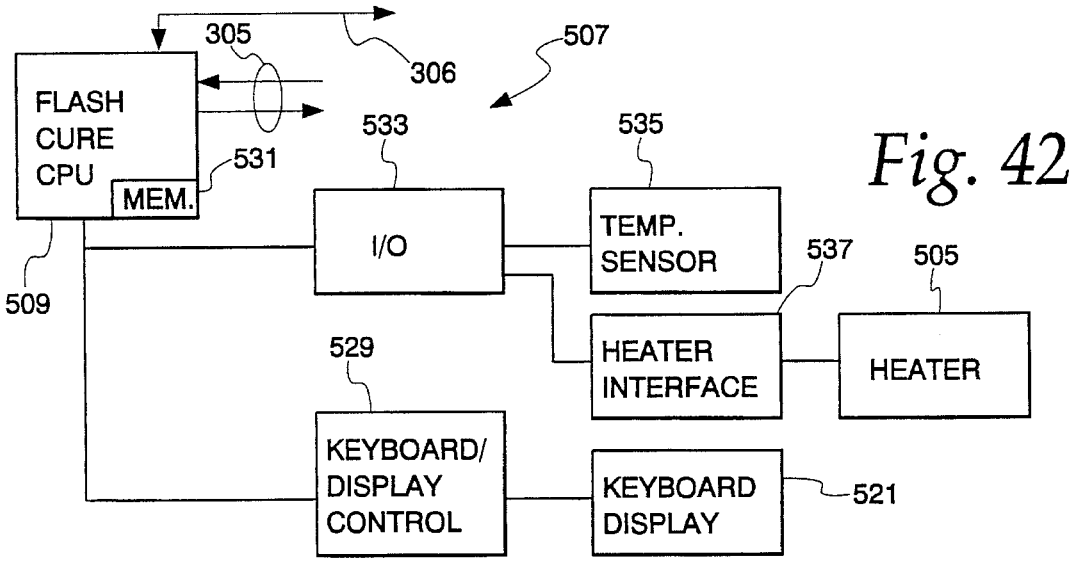
Fig. 42
Fig. 43
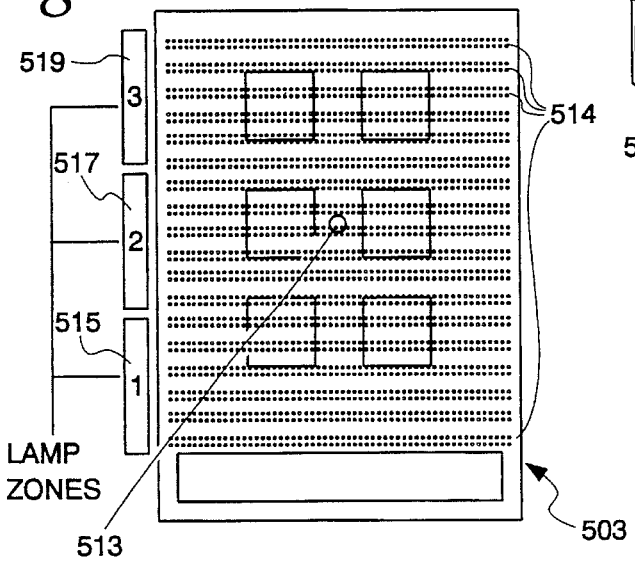
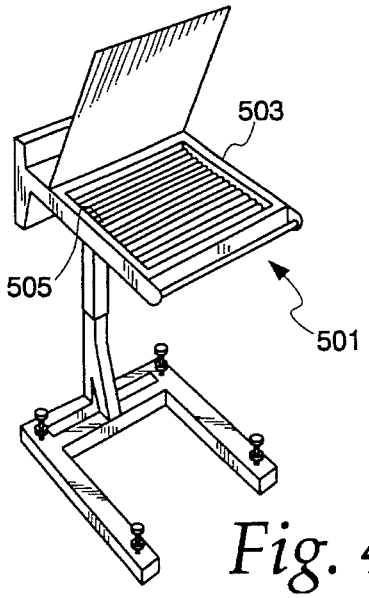
Fig. 41
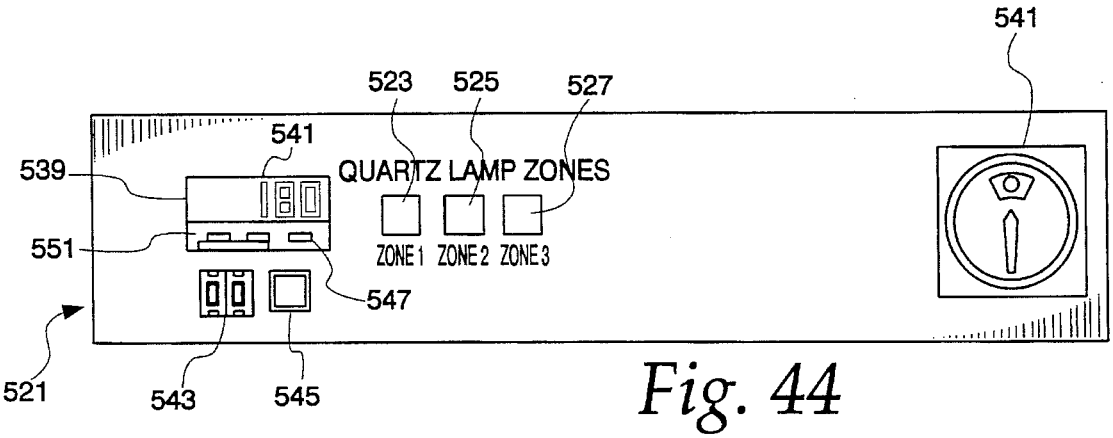
Fig. 44

SCREEN PRINTING APPARATUS WITH PALLET REGISTRATION

BACKGROUND OF THE INVENTION

This invention relates to a screen printing apparatus having a pallet registration system and having a screen and squeegee for forcing a printing material such as ink through the screen to print on a substrate.

The present invention will be described in connection with an illustrated embodiment which is in the form of an oval screen printing machine; but it is not limited to an oval screen printing machine because it is applicable to other forms of screen printing apparatus, such as graphic screen printers, rotary screen printers, bottle printers, etc. A conventional oval screen printing machine typically has a series of pallets connected to a chain for traveling in an endless path through a plurality of printing stations at which are mounted printing heads for printing on the substrates carried by the pallets. Each of the printing heads is lifted at a head stand located outwardly thereof by a lifting cylinder mounted in the head stand. The head stand is electrically connected to a main common controller, such as a programmable logic controller (PLC), which operates the fluid cylinder to raise the print head to allow pallets and the substrates to leave the print head, and to enter the next adjacent print head which is also in the open position. The PLC controller causes the printing heads to lower to their closed position for printing. The opening and closing motions are relatively large movements and are not precisely controlled in their travel speed or easily adjustable as to their length of stroke. The clam shell operation usually allows opening of the head sufficiently to expose the bottom of the printing screen to wipe the same clean, which is a good feature of the clam shell press.

Present oval machines are to a certain extent, expandable from an initial number of printing stations, e.g., from 16 to 20 printing stations, but require expensive and time-consuming operations such as cutting the existing frame and welding on a new frame portion and adding a heavier motor to overcome and move the additional weight of pallets and chains, and friction loads. Typically, the PLC must be reprogrammed; and the entire process involves complex electrical and mechanical operations and connections that are time-consuming and expensive.

During a printing operation, the screen is separated from the substrate by a so-called "peel mechanism" that peels the screen off the substrate to which it is adhered by the printing ink. The peel rate is usually adjustable mechanically in discreet increments often by moving a pin in a lever arrangement to change a mechanical ratio. Such changes in peel rate are done when the printer is stopped and are at a fixed angle or rate once adjusted. The adjustments are relatively large in magnitude. Thus, there is a need for a peel mechanism that is adjustable quickly in small increments without stopping the machine and doing a mechanical adjustment. Further, there is no ability in machines of this kind to do a universal adjustment of the peel rate of several machines simultaneously from a common central controller.

In many conventional screen printers, the length of stroke is controlled by proximity switches that are actuated at limit positions. While the positions of the proximity switches may be mechanically adjusted to change the start and end positions of the stroke, the adjustments are relatively crude. That is, the positions of the limit switches are not very precise, e.g. in 0.001 increments, and are not adjustable to very small displacements of 0.001 inch or the like by a remotely operated controller. In combination with the proximity switches, there are often used shock absorbers, or dashpots, that are used to cushion the stopping of the travel of the squeegee carriage. Proximity switches and shock absorbers tend to have limited life and need to be replaced. The limit switches also preclude multiple print strokes at the same printing station of different stroke lengths. Sometimes, it would be desirable to have different print stroke lengths for a first and second print stroke at the same station. For example, when printing a face on a T-shirt, a light amount of ink may be deposited for printing the face; and a heavy amount of ink may be deposited for the name of the person. It would be desirable to print a light stroke over both the face and name, followed by a short second stroke at the name to deposit more ink over the name, while leaving the face without a second deposit of ink. This is not possible with the mechanical proximity switches and drives currently in use. Further, most controllers are not programmed to provide such a double stroke at the different printing stations.

The amount of off-contact, that is, the spacing of screen from the substrate at the time of printing, is adjustable mechanical by adjusting screws or stops in conventional screen printing presses, such as the above-described oval printing press. Each screen head must be adjusted individually while the head is stationary. Thus, it may be a time-consuming proposition to adjust a single head's off-contact position from a thin substrate such as a T-shirt to a thicker substrate, such as a sweatshirt. It would be preferable that the off-contact distance could be adjusted on the fly and in very small precise increments to either increase or decrease while the machine is operating and done globally, as when switching from T-shirts to sweatshirts.

Another shortcoming of conventional oval machines is the inability to change the print and cure sequences easily because the print heads cannot be easily shifted between stations and without being re-leveled and re-doing their subroutines, of electrically-timed operations with respect to speed, stroke length, peel rate, etc. The shifting of printing heads allows the purchaser of the screen printer to purchase fewer printer heads and the option to later add more printing heads, if desired. The shifting of a head in the common oval printing machine requires a shifting of the head stand and requires a technician to come in and level the print head relative to the platens, thereby defeating a quick, inexpensive change of printing sequence by the shifting of print heads to different printing stations.

A further problem with most current screen printing machines and oval screen printing machines in particular is that each machine is mechanically set up and operated on an ad hoc basis such that it while it may be easy to run the same job later on one screen printer, it is impractical, if not impossible, to run the same job on a second screen printer because the respective screen printers each has been set up on its own ad hoc basis. There is absolute or universal positions or units of operation that allow transmission of the set up variable parameters in absolute values from one screen printer to a second screen printer and achieve the same results. Thus, it is currently difficult to transmit operating machine data from one location to a second remote location to run the same printing job at this second remote location as was run at the first location.

During a set-up operation, it is necessary to accurately register the print screens at a number of print stations. Thus a pallet must be moved from print station to print station to perform such registration. In conventional oval printing machines, a pallet is stepped forward from one print station to the next, with a pause at each station. In a printing machine having a large number of printing stations this results in wasted set-up time when a patent is to be moved more than one print station forward. It would be an advantage if a pallet and a destination print station for that pallet could be identified and the printing machine moved the pallet directly to the destination in the shortest distance, without pausing at intermediate print stations.

Another deficiency in the current oval printing machines and also in many other screen printing machines is the quick change of pallets. In some instances, the changing between overall pallets and standard pallets may take two hours. In many instances, very large and heavy pallets are difficult to secure on their pallet supports and require the use of wrenches for the fasteners used. Thus, there is a need for a faster quick and disconnect of pallets, particularly the larger and heavier pallets.

Additionally, the registration of the substrate for printing is a problem particularly with the larger oval printing machines that may have as many as thirty-six (36) stations. The pallet supports are connected to a chain drive may loosen or become worn with time and allow movement of the pallet supports relative to one another. Because the pallet supports are connected at spaced locations to a chain that goes around a sprocket at each end of the machine, an elastomeric bushing is used at one connection to allow relative movement between the pallet support connections to the chain as one leads the other into and about the curved sprocket path; while the other connection is still traveling along a linear path. The bushing is compressed and then expands in its travel about a curved path. The current conventional machine registers at both the inner and outer edges of the pallet support by discreet registration members that are moved individually by separate actuators into a notch on the respective inner and outer edges, and the pallet support is shifted by compressing the elastomeric bushing. The elastomeric bushing only allows about 1/16" or less shifting of the pallet support, which often, is not a sufficient distance to obtain the registration desired. Thus, there is a need for a registration system that is limited by compressing an elastomeric bushing for the pallet support and is independent of the pallet support unlike the prior art system.

SUMMARY OF THE INVENTION

In accordance with the present invention, there is an improved screen printing machine that overcomes the above-described shortcomings of conventional, prior art screen printing machines.

Unlike conventional registration systems in screen printers of various kinds, the present invention floats the pallet and registers inner and outer ends of the pallet while it is floating on its support arm. The pallet is secured or interlocked with the pallet support and is carried thereby into a position at each printing station to be engaged by a locator which unlocks the pallet and frees it to shift in and out and left to right to register the image on the substrate with the image on the printing screen at the printing station. Preferably, one of the pallet locators is fixed, and the other movable pallet locator shifts the pallet into contact with the fixed locator.

Further, the invention provides an improved and quick release of the pallets from the pallet support to reduce very substantially the amount of down time used to remove the pallets for one job, i.e., an overall printing job to another job, such as printing on both sides of the substrate with a flip pallet. It is preferred to mount the pallets and to interlock them to pallet support arm without the use of mechanical fasteners, such as the commonly used bolts or nuts, that require the use of wrenches. The nuts are often at difficult-to-reach locations, and there are several fasteners for each pallet. In the preferred embodiment of the invention, the pallets are spring-biased into a latched or interlocked position; and a mechanical actuator is actuated to shift the pallet against the spring force to an unlatched position where the pallet may be lifted from the pallet support arm, and a new pallet installed on the support arm. Release of the actuator allows the biasing spring force to latch and/or interlock the new pallet to the support arm. Preferably, the mechanical actuator is at one pallet changing stations and a series of pallets are stepped intermittently into the pallet changing station with the mechanical actuator being either manually controlled at the changing station or operated at preset, timed intervals for each pallet changing operation.

BRIEF DESCRIPTION OF THE DRAWINGS

FIG. 34 represents memory storage locations of memory of the print controller;

FIG. 35 is a block diagram of the master controller of FIG. 28;

FIG. 36 represents memory locations storing status information for the print stations of the printing machine;

FIG. 41 shows a flash cure unit for use with the printing machine of FIG. 1;

FIG. 42 shows a block diagram of a flash cure controller;

FIG. 43 shows a heater panel of the flash cure unit; and

FIG. 44 shows a keyboard/display of the flash cure unit.

DETAILED DESCRIPTION OF THE PREFERRED EMBODIMENT

Figure 1:
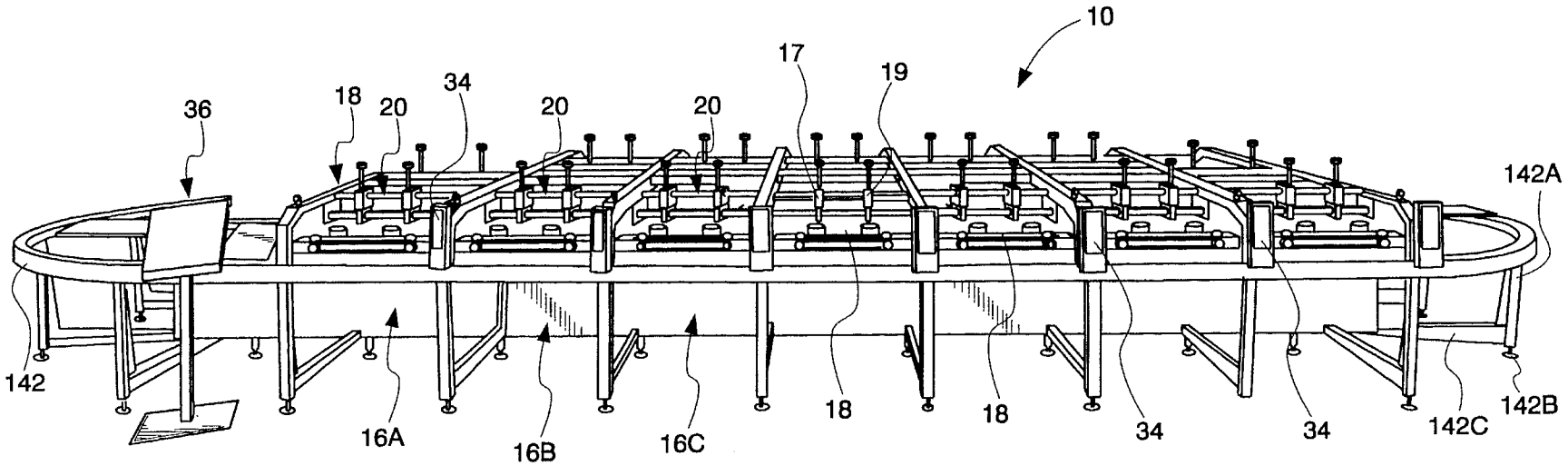
FIG. 1 is a perspective of a screen printing apparatus embodying the invention.

As shown in the drawings for purposes of illustration, the invention is embodied in a screen printing apparatus 10 (FIGS. 1 and 2) of the kind having an endless path of travel for pallets 12 that carry substrates 14 such as textiles, e.g., T-shirts or sweatshirts, through a series of printing stations 16A, 16B, 16C, etc. at which are located printing heads 18 for printing on the substrates. Each of the printing heads has a squeegee and flood bar carriage 20 that reciprocates in its associated printing head carrying a flood bar 22 to spread the ink of a printing screen 24 and a squeegee 26 to force ink through the screen to form an image on the substrate on the pallet beneath the screen. An endless chain 25 mounted on a central, elongated frame 27 carries the pallets 12 in an endless path through the various printing stations.

In accordance with the present invention, the off-contact position or distance X (FIG. 2) between the screen 24 and the top of the substrate 14 is set or adjusted during set-up easily and in finite, precise increments by operation of position controllable electric motors 30 that are carried on the printing head 18 and are operated electrically to shift the printing screen rectilinearly. Herein, there are four, position controllable electric motors located on the printing head 18 at the four corners of a printing screen holder 32 in which is releasably mounted the printing screen. The position controllable motors are preferably in the form of stepper motors that are electronically stepped and which are at known countable positions from an electronic home or set point, and for which there is a feedback so that the exact precise position of the printing screen in the printing head 18 is known at all times.

Figure 3:
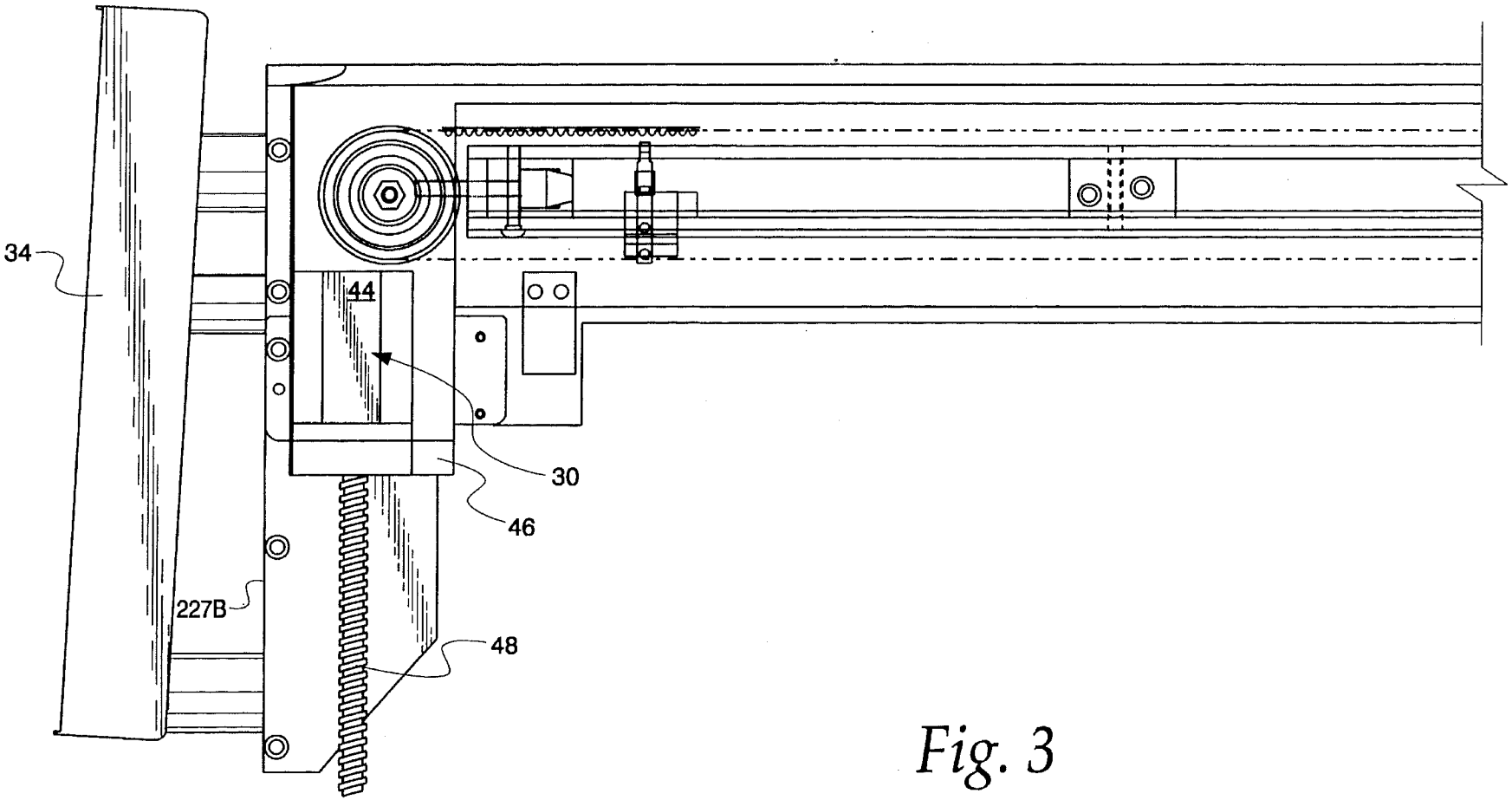
FIG. 3 is a partial elevational view of a head controller and stepper motor on a screen head.

As will be explained in greater detail, the stepper motors 30 may be operated, during set-up of a printing operation, by a controller 34 associated with the printing head or a master or common controller 36 (FIG. 1) mounted at a remote location from the printing head. As best seen in FIG. 3, the local controller 34, which is preferably mounted on the printing head, has an off-contact switch 38 (FIG. 31) preferably in the form of a touch pad switch having a down arrow switch 38A to decrease the off-contact distance, and an up arrow switch 38B to increase the off-contact distance. A display panel 40 on the controller 34 shows in inches and thousandths of an inch the off-contact distance. It is possible to change the off-contact distance by as little as 0.001 inch in the up direction by touching the up switch 38B or by 0.001 in down switch 38A. The off-contact position for a given job having a specific type of ink, stroke speed, etc. may be electronically or otherwise stored and used by this same screen printer or can be communicated to a second remote printer for use at the remote second printer. This is because the distances are absolute distances from the pallet and hence are replicable at a remote location for the same printing station. The off-contact distance may varying from station 16A to station 16B, or to station 16C, etc. with each station having its data stored for a given job, as will be hereinafter explained in detail in the electrical control description of the application.

Figure 4A:
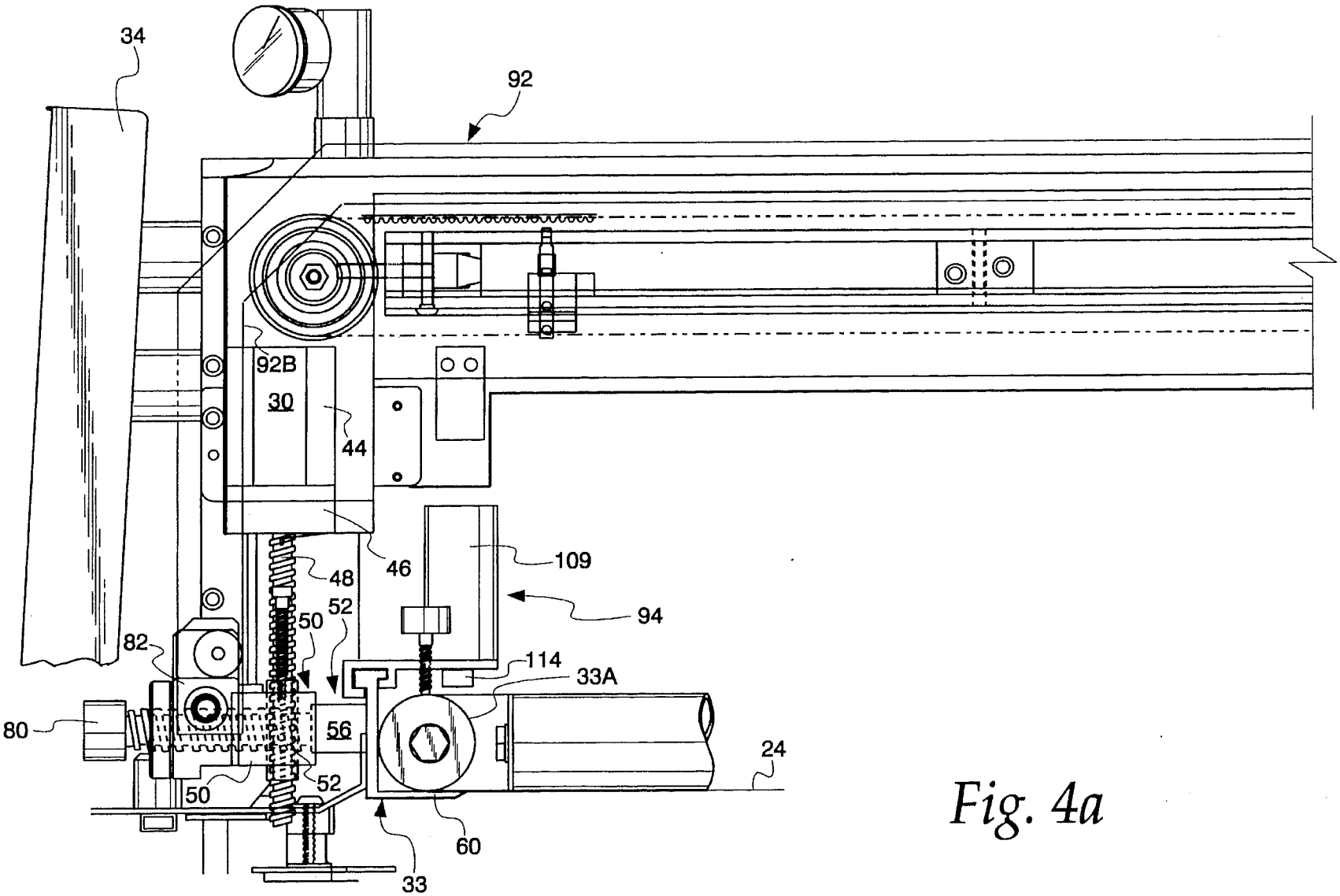
FIG. 4*a* is a partial elevational view of a mounting of the front screen holder.
Figure 4B:
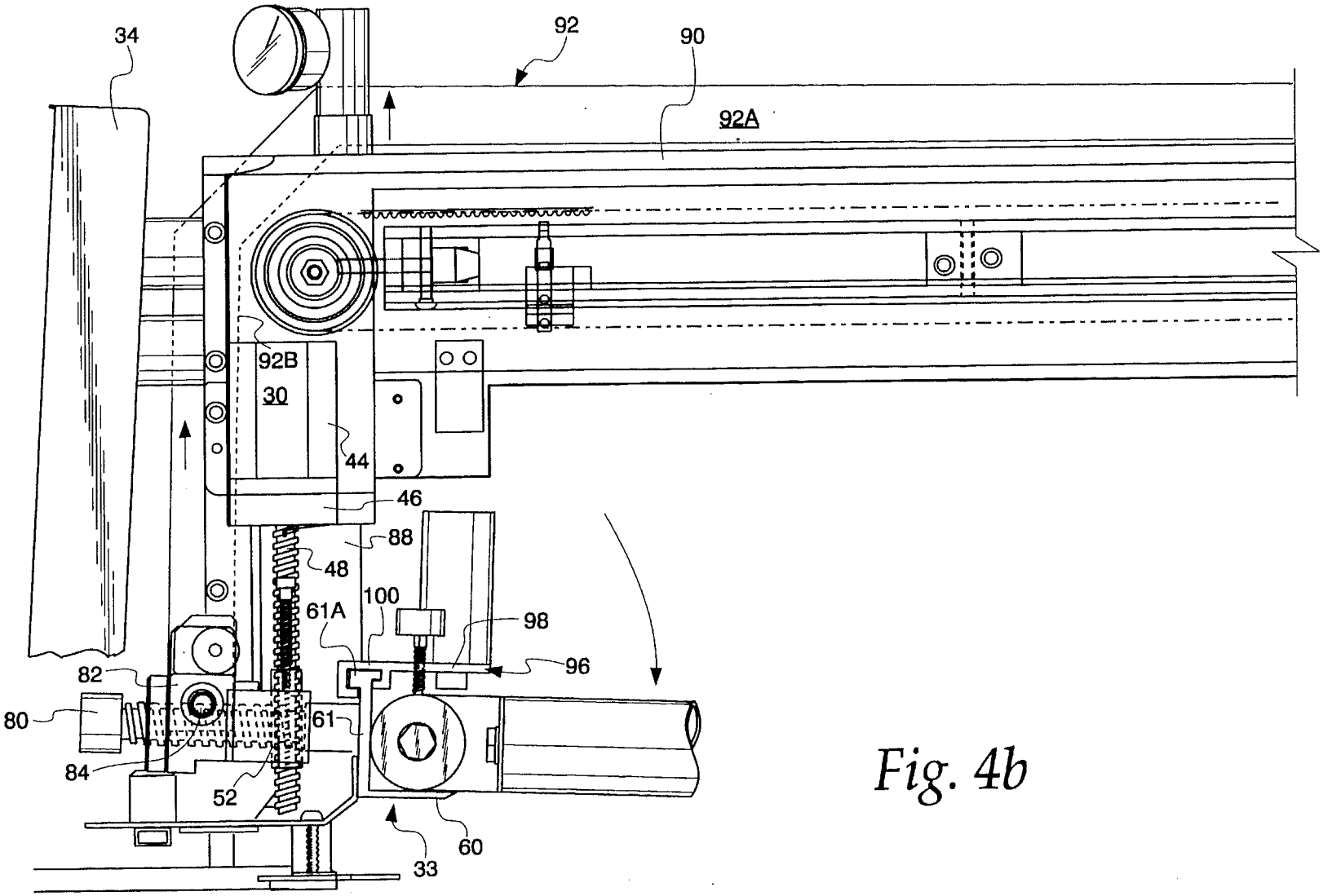
FIG. 4*b* is a view similar to FIG. 4*a* with the front screen holder rotated slightly downwardly.

As best seen in FIGS. 3 and 4, the stepper motor 30 has a motor body 44 mounted by a mount in the form of a horizontal support plate 46 on the printing head 18 with a motor output shaft connected to and turning a depending, rotatable screw 48 threaded in a nut 50 (FIG. 4*a*). The nut is fixedly secured to a support bracket 52 having a lower horizontal screen holder support bar 56 connected to the usual screen holder 32 having a horizontal flange 60 carrying one end of the printing screen 24.

Figure 27B:
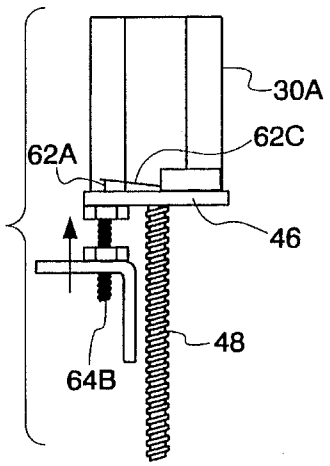
FIG. 27*b* is an elevational similar to FIG. 27*a* with the switch actuator raised to actuate the switch.
Figure 27A:
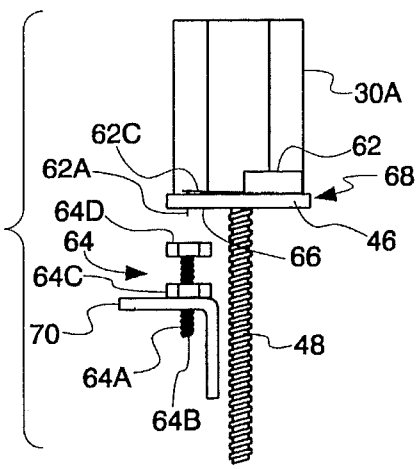
FIG. 27*a* is an elevational view of a stepper motor, switch and switch actuator in a first position.

The position of the screen 24 relative to the pallet 12 is known by counting from a home position for the stepper motors 30. Herein, the home position is the upper position when an upper limit switch 62 (FIGS. 27*a* and 27*b*) is broken as an adjustable stop 64 carried by the screen holder 32 abuts a stationary stop which, in this instance, is a bottom surface 66 of a horizontal support plate 46 for the stepper motor. The adjustable stop 64 is preferably in the form of a threaded bolt 64A having a shank 64B threaded in the microregistration bar 70 and a lock nut 64C tightened against the top of this bar 70 to prevent inadvertent turning of the bolt. The bolt has an upper head 64D that is aligned with a plunger pin 62A mounted in the stepper motor support plate 46 to hit the plunger pin and push it up to lift a depending free end of a metal leaf spring contact 62C from between a pair of switch magnets mounted to the stepper support plate 46. As the bolt head drops down below the plunger pin, the leaf spring is biased to lower its plunging pin 62A between the magnets to shift the state of the switch 62. The projected length of the plunger below the plate is such that when the bolt head 64D hits the stop surface 66, the plunger pin 62A has just opened the magnetic switch. The bolt is threaded and can be turned, and thereby be adjusted finely to change the stop or home position from which the displacement count of the stepper motor is started.

Figure 5A:
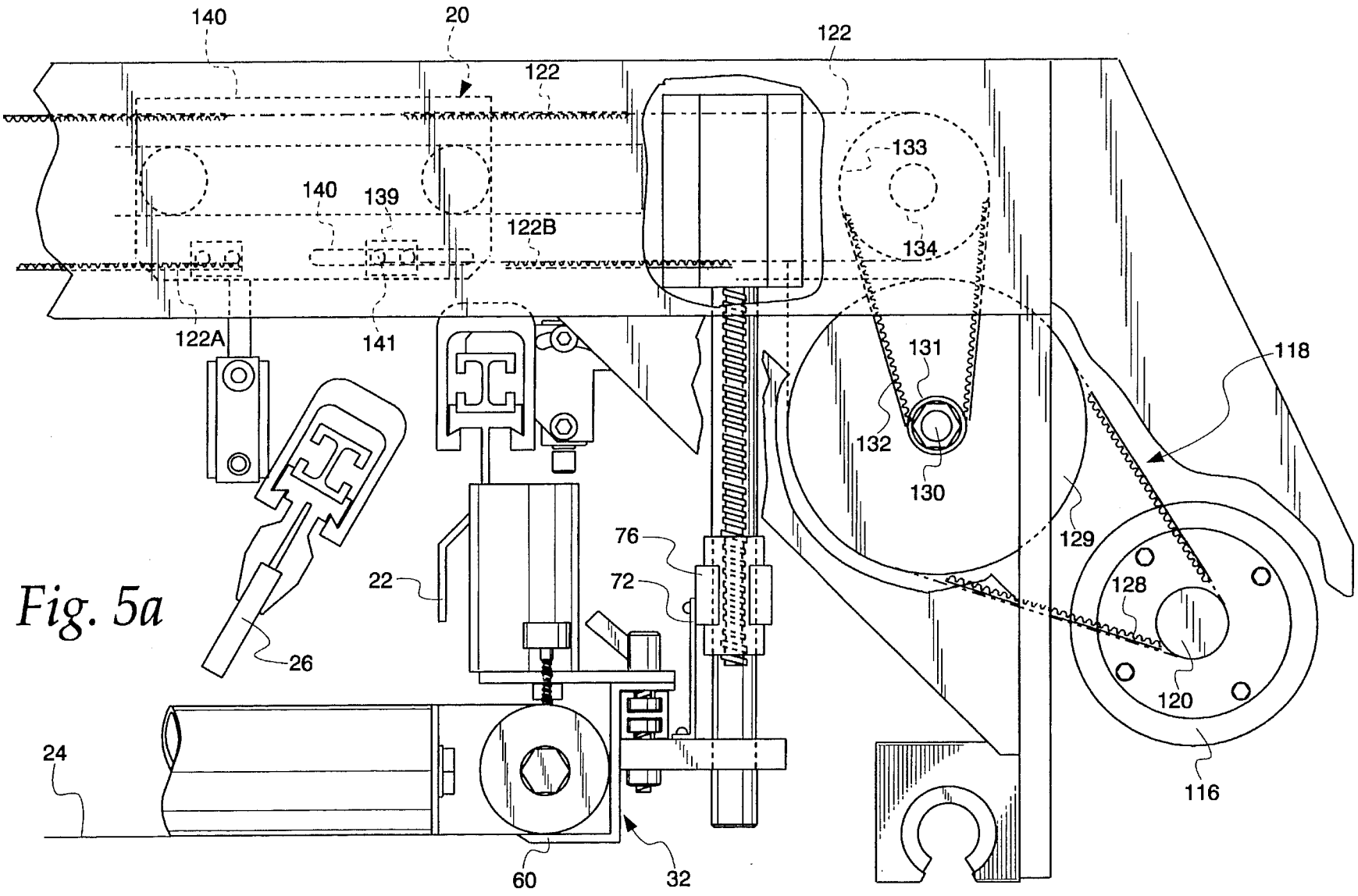
FIG. 5*a* is a partial, elevational view of the mounting of the rear screen holder.
Figure 5B:
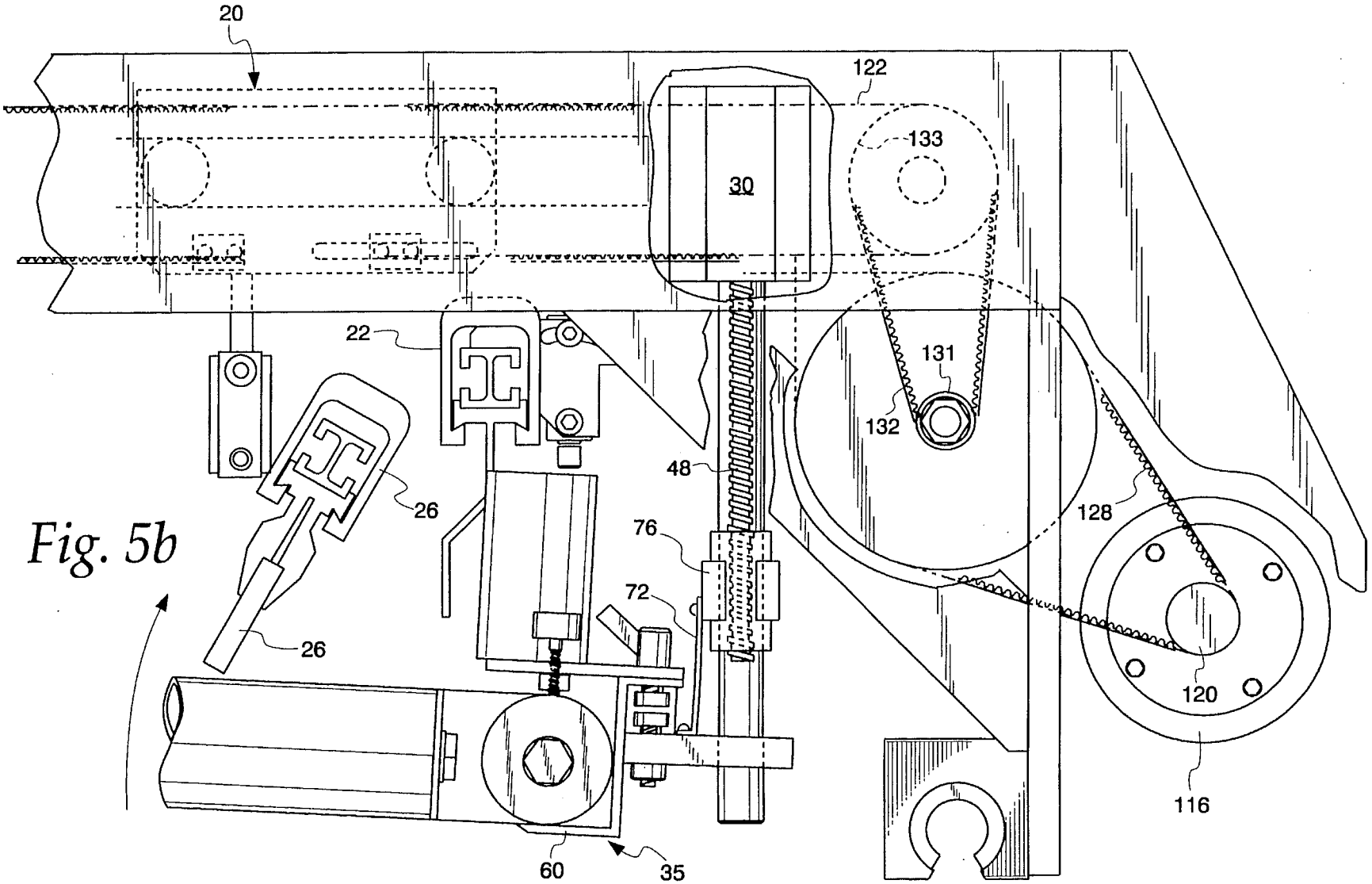
FIG. 5*b* is a view similar to FIG. 5*a* with the rear screen holder bent slightly from the position of FIG. 5*a*.

It will be appreciated that, as the front pair of stepper motors 30 raise to lift the front end of the screen 24 to peel, the screen frame 25 pivots about the rear of the screen frame being held in the rear screen holder 35. As the front end is lifted, it would cause the front end of the screen frame 25 to travel a longer distance along an arc if the rear screen holder were fixed rigidly. To offset this, the rear screen holder 35 and the rear end of the screen frame 25 are mounted so as to be shiftable. Herein, the rear screen holder 35 is mounted is spring urged to a normal position except when during a peeling operation, the rear screen holder is allowed to shift slightly rearwardly. For this purpose the rear screen holder 35 is connected by vertical, thin, steel leaf springs 72 (FIG. 5) that are mounted at lower ends to a lower, screen holder support bar 74 and are mounted at their upper ends to an upper slotted bar 76. The rear screen holder is fastened to a vertical front wall of the cross bar 74. The thin, steel leaf springs allow the lower cross bar to move in somewhat an arcuate path back and forth relative to the stationary upper ends of the leaf springs 72 that are bolted to the upper, slotted bar 76. The leaf springs allow forward or rearward movement, but the leaf springs are so stiff, that they do not permit left to right movement in the direction of travel of the chain which moves the pallets in the left and right directions. Herein, the lower end of the vertical leaf springs are bolted to the rear side of the lower, screen holder support bar, and the upper ends are bolted to the front side of the upper slotted bar. The rear stepper motors have their respective screws 48 threaded in the nuts 50 fixed to the top of the movable, upper slotted bar 76.

It is difficult to allow the front ends of the screen frame 25 and the front screen holder 33 to pivot and to be microadjusted for registration. Herein, one may make the usual microregistration adjustments in the usual way by turning microadjustment screws 80 (FIGS. 4*a* and 4*b*) that are threaded in a front registration bar 82 that is mounted on a central, horizontal pivot shaft 84 which is fixedly mounted at its opposite ends to blocks 86 on the front depending ends 88 of a pair of horizontal printing arms 90 of the printing head 18. The front registration bar has a hollow bore with the pivot shaft extending through the bore. The threaded shanks of the microadjustment screws 80 extend to and support the front, screen holder bar 56. The front, screen holder support bar 56 and the rear, screen holder support bar 76 are parallel and horizontal, and in a common plane to hold the screen frame 25 horizontal and parallel to the pallet 12 and substrate 14 thereon.

The microadjustment screws 80 are threaded through the registration bar 82 and are attached bracket 52 to shift the screen holder support bar 56 and the front screen holder 33 thereon in a front-to-rear direction. Thus, it will be seen that the front screen holder 33 may rotate about a pivot axis through the center of the pivot shaft 84, as shown by the upward pivoting of the screen holder between the lower horizontal position of FIG. 4*a* and the upper inclined position of FIG. 4*b* as well as be shifted for and after by turning the microregistration screws 80.

It is preferred to provide bridges 92 and 93 between the front screen holder support bar 56 and the rear, screen holder support bar 74 to assure that there is no slippage of a round, front screen frame member 33A (FIGS. 2A and 2B) in the front screen holder 33 during the peeling operation. Such slippage would change the position of the image on the screen relative to the front screen holder. Air clamps 94 are mounted on the screen holder 33 to clamp the screen frame members 33A to the front screen holder 33. It has been found that even though the air clamps are applying a good clamping force on the top surface of the front, rounded screen frame members 33A, that some sliding may occur with the rounded member sliding on the lower flange 60 of the front screen holder 33. This does not occur for square or rectangular screen frames which have a large, flat, wide surface abutted against the lower screen holder flange 60. This wide, flat surface on the screen frame member (not shown) does not slide so easily along the flange 60. The bridges 92 and 93 have a central, horizontal portion 92A and 93A extending above and parallel to the screen frame and depending legs 92B and 93B which are fixed to the fronts screen holder bar by fasteners and to the rear, screen holder support bar 56 by fasteners 93C. The bridges 92 and 93 thus tie the respective front and rear screen holder supports 56 and 74 together and prevent an independent downward movement of the front screen holder due to slippage of the front screen member 33A along the front screen holder flange 33*a* as would change the position of the image on the screen relative to the front screen holder 33.

Figure 6:
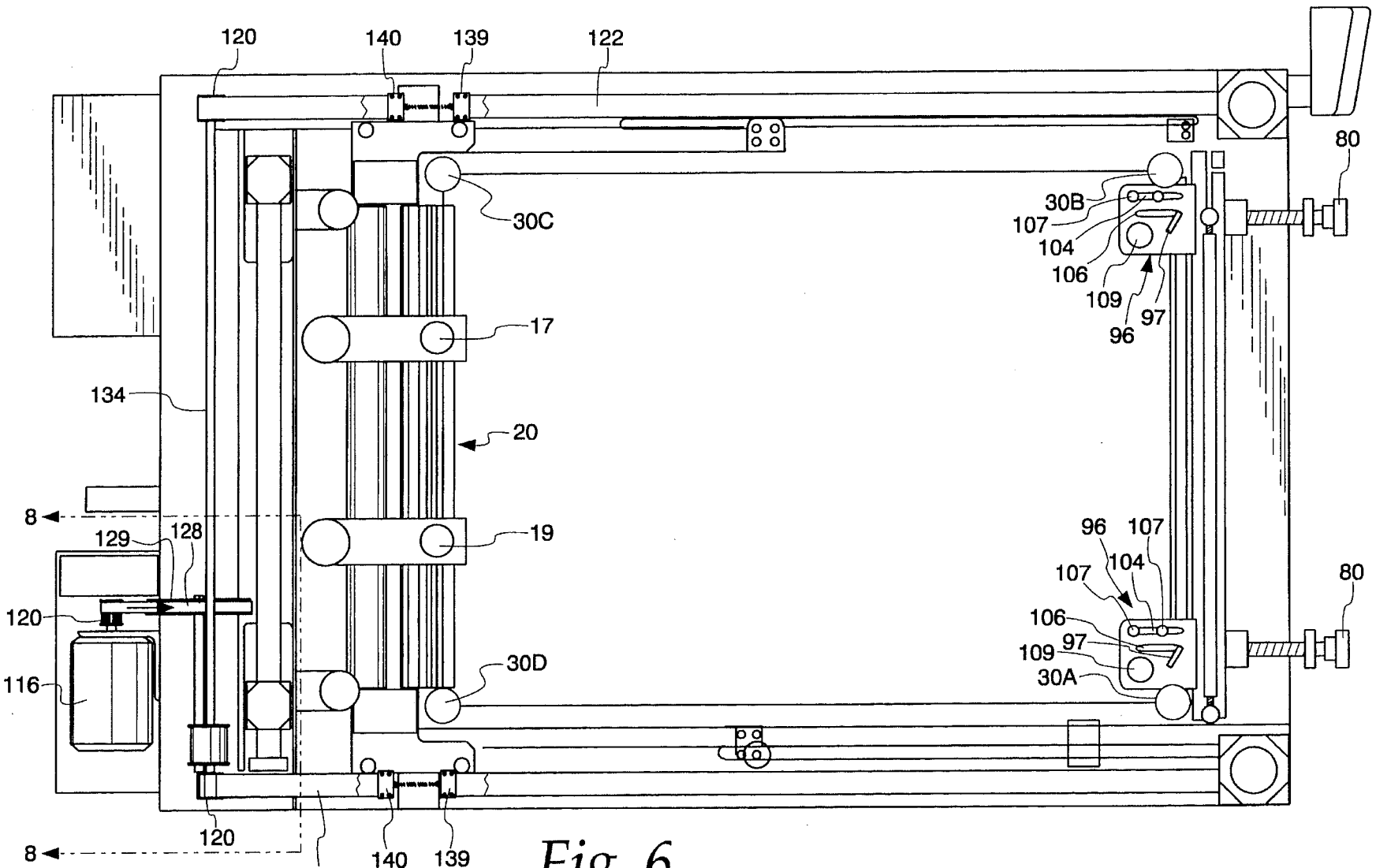
FIG. 6 is a plan view of the print head.
Figure 7:
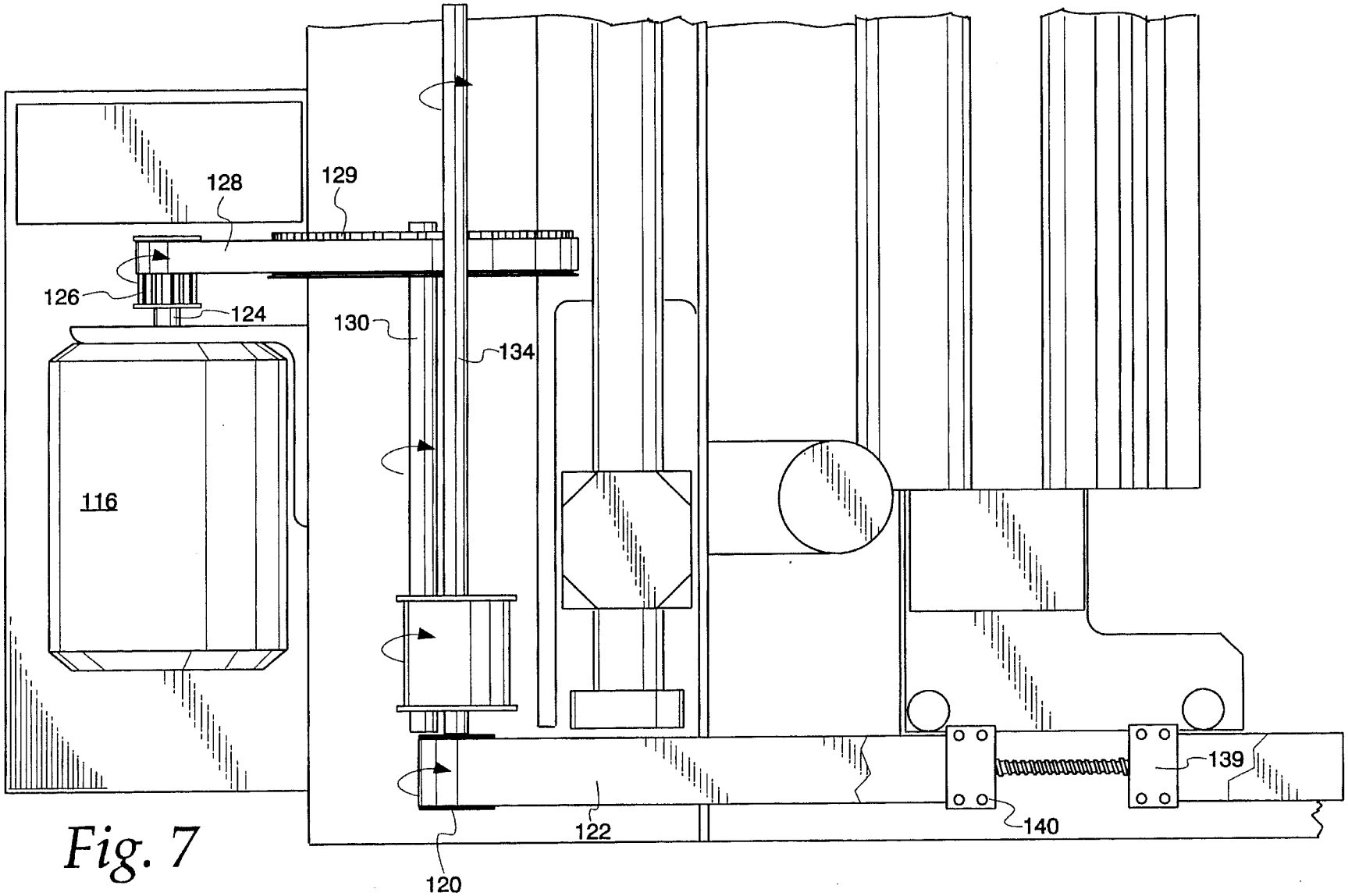
FIG. 7 is a fragmentary plan view of the motor drive for the squeegee carriage.
Figure 8:
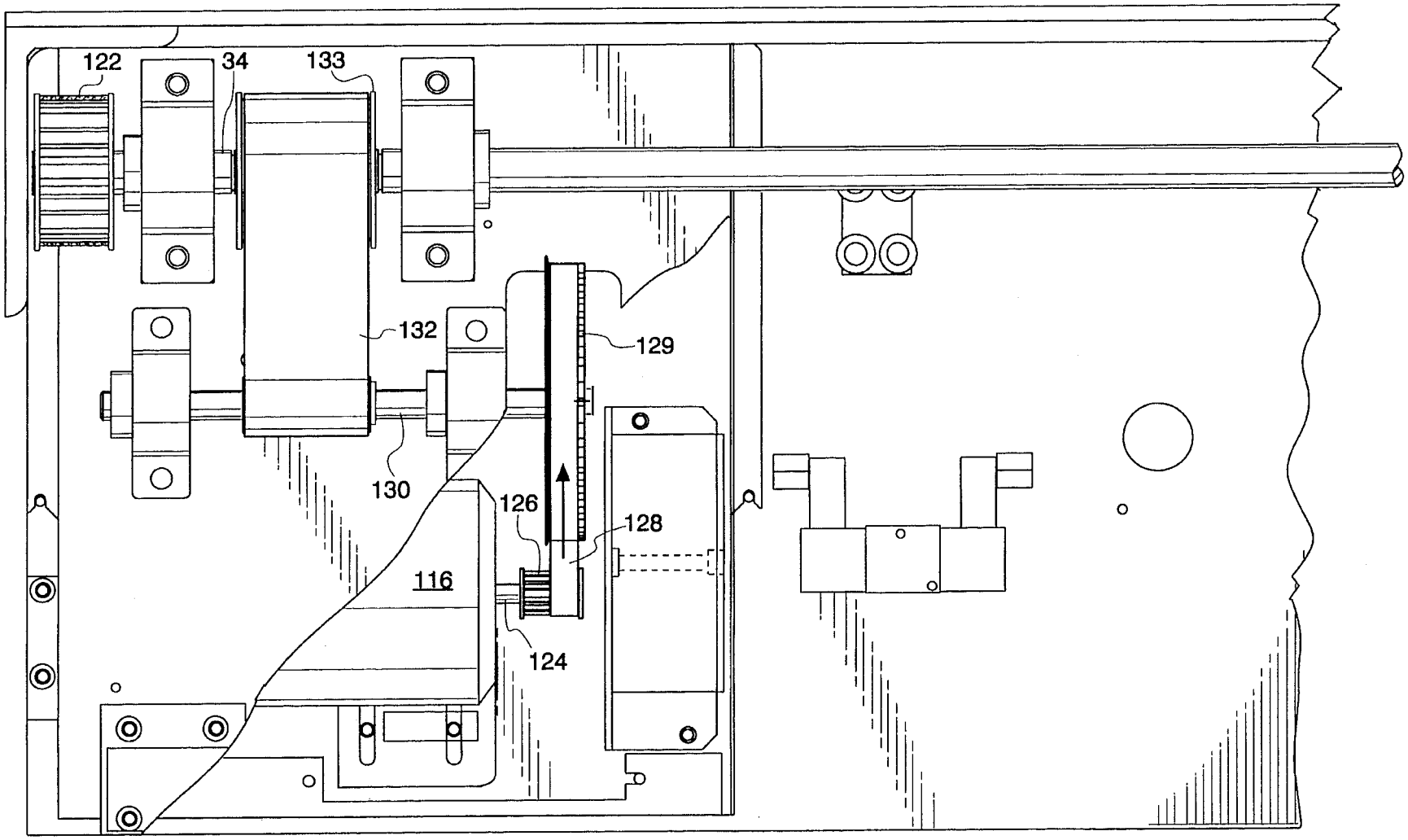
FIG. 8 is a fragmentary plan view of the motor drive for the squeegee carriage.

Each of the air clamps 94 is mounted on a slide 96 (FIG. 6) which is slideably mounted on the top of the front, screen holder 33 and rear, screen holder 35 to allow positioning of the air clamps at the best location for clamping of the different sizes and different kinds of screen frames such as square or circular cross-sectional frame members. The slide carries an upper horizontal locking handle 97; and the rear end of the slide has dovetailed slot or groove 100 receiving an enlarged, shouldered upper end 61A on the vertical leg 61 of its associated, slotted, screen holder 33 or 35. The position of the clamp slide may be shifted forwardly or rearwardly as well as from left to right along the head 61A of the upstanding leg 61 of the screen holder. To this end, a pair of parallel slots 104 and 107 are formed in the horizontal slide with a pair of pins 106 being mounted in the slot 104, and the shank 108 of the quick release, locking handle 97 extends through the other one of the slot 106. The shank and the pins allow only front to rear movement of the air clamp relative to the slide 96. The clamp comprises a fluid cylinder, preferably an air cylinder 109, with a spiraled air hose connected thereto for adjusting the hose length with changes of the clamp positions, and with the plunger of the cylinder carrying a pad 114 (FIG. 4*a*) to abut the top of the end screen frame members 33*a*.

The printing stroke of the squeegee carriage 20 is readily adjusted in length and in speed of travel without the use of mechanical limit switches and dashpots or other shock-absorbing devices that become worn and need maintenance. Often, in the conventional screen printers, the stroke length is set by limit switches which are shifted manually to different positions along the printing head to determine the start and stop positions of the carriage travel. Also, in conventional presses, the speed of the carriage travel often may be adjusted as by turning a rheostat or the like with the operator using his/her skill and knowledge to obtain the proper printing speed for the squeegee for the particular ink being used and for the amount of ink being deposited on the substrate.

In accordance with the present invention, the speed and length of carriage travel are controlled electronically by the use of a servo motor 116 and its control system that can be electronically slowed, i.e., decelerated along a power curve, to a stop position to eliminate shock, and which is driven with a precisely controlled speed in absolute, known units of inches per second (i.p.s.). The typical squeegee travel speed is from about 15 to 40 i.p.s. with preferred motor providing a speed of 0–40 i.p.s. The print head controller 34 and the remote controller 36 show the printing stroke speed in tenths of an inch per second, which is an absolute rather than a relative measurement; and therefore, the exact speed used for a particular printing job may be stored for later readout for use on this same machine or for use on another machine. The speed to print a heavy, sticky ink or a thin, non-sticky ink varies very substantially as does their viscosity. Also, the physical and chemical composition of the ink varies, e.g., acrylic inks are often used which need a higher shearing speed of squeegee travel than do ordinary screen printing inks. If a squeegee speed is too fast, the squeegee may just hydroplane across the top of the ink. Often, ink suppliers used nozzles and tubes to ascertain ink viscosity as an aid to printers for setting up their squeegee and flood bar travel speeds. With the present invention, an absolute value in inches per second may be found for each ink during an actual printing operation and this empirically arrived information may be stored and used in the next set up or a set up of this same printing machine or used to set up a different printing machine.

The servo motor 116, as best seen in FIGS. 5–8, is carried at the rear of the printing head 18 and is preferably an A.C. servo motor having connected through a speed reducer 118 to a drive sprocket 120 for a chain 122 connected to the squeegee and flood bar carriage 20. Herein, the servo motor has an output shaft 124 which carries a small sprocket 126 driving a toothed timing belt 128 entrained about a larger sprocket 129 fixed to a speed reducer shaft 130 mounted horizontally in the screen head by a bracket. The speed reducer shaft 130 carries a wide timing belt sprocket 131 of a smaller diameter, and a wide belt 132 extends upwardly to a larger diameter sprocket 133 fixed to a chain drive shaft 134 which also carries the chain drive sprocket 120. Because the motor is servo controlled and always has feedback as to where it is, and because of the toothed timing belt drive of the carriage 20, the position of the carriage 20 is always known. By use of the controllers 34 or 36, the front or rear limit positions for the travel of the squeegee carriage 20 may be easily changed; and also the speed of carriage travel may be always known and readily adjusted by appropriate operation of the upper or down switches on the controllers, as will be explained in detail hereinafter.

The carriage drive chain 122 for each carriage 20 may be adjusted as to its length to keep the chain taut so that there is no looseness or play therein that would adversely affect the exact position of the carriage 20 relative to the stepper motor 116 and the count therein for the location of the carriage for a given count. Herein, one end of the chain **122*a* is fastened by a bracket 138 to a carriage block 140 while an opposite end 122*b* of the chain is fixed to a slide 139, which is mounted to slide horizontally in a slot 140 in the carriage block. Fasteners 141 are tightened to secure the slide 139 to the block 140** when the chain is taut.

In accordance with another aspect of the invention, a previously printed image on the substrate 14 on a pallet 12 is registered at the next printing station 16 so that the next printed image will register with the incoming, previously printed image. Registration is a problem when one considers that the machine may be very long, e.g., having 36 printing stations with an endless chain 25 extending about the entire oval. The chain may become worn or loose and change the registration of different color images relative to one another; the registration of images relative to one another, is desired to be within about 0.001 inch. Each pallet is carried by the chain in an endless orbital path, which in this instance, is an oval path; and each pallet 12 is detachably mounted to a pallet support 150.

Figure 14:
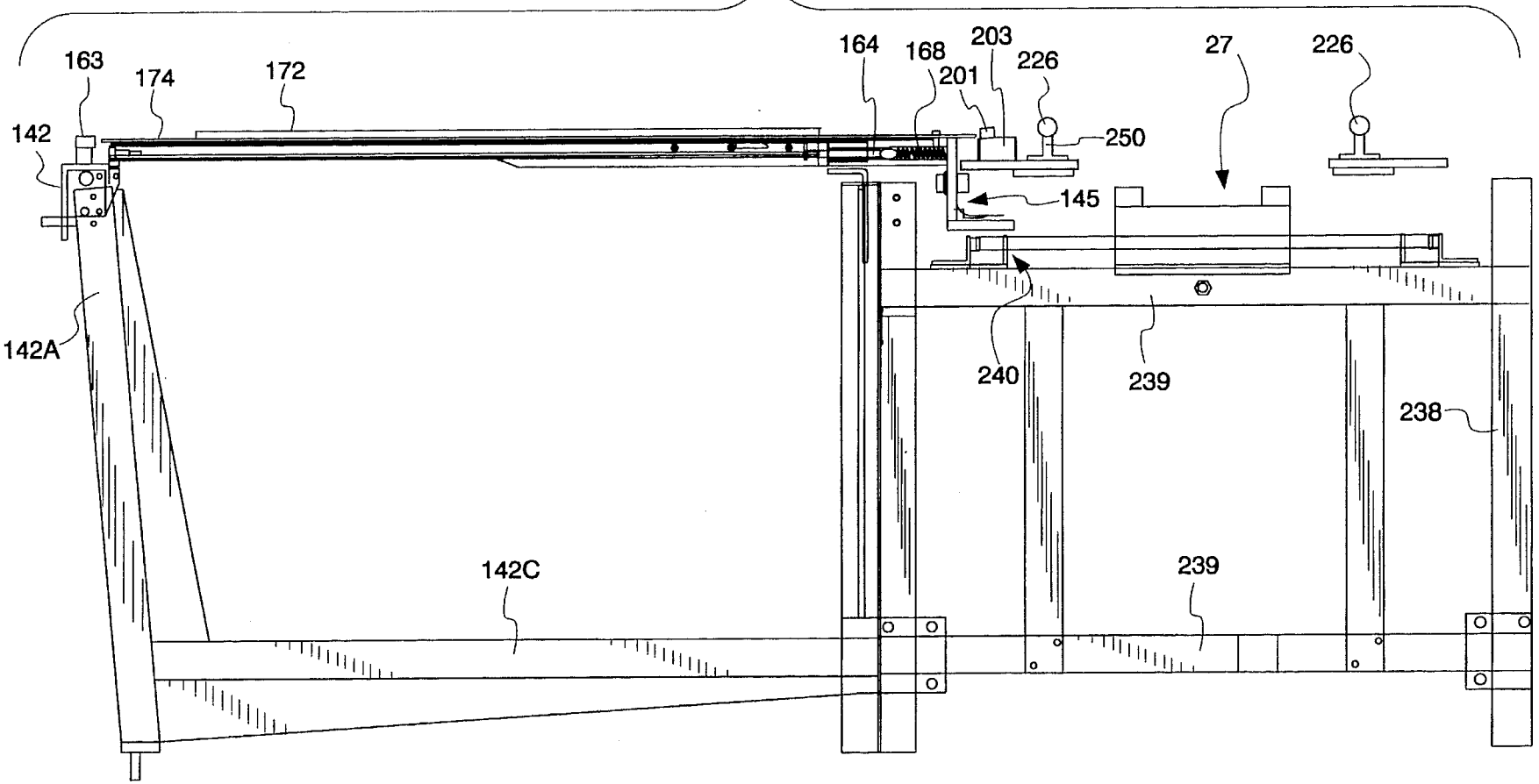
FIG. 14 is an elevational view of the frame, a pallet and a pallet support arm.

Herein, the pallet support 150 comprises a long tapered arm 152. The arm has an elongated, hollow, tubular portion **150*a* which extends between the central, stationary frame where the chain is located and an outer, horizontal support rail 142 (FIG. 1) encircling the central frame. The small outer end 150*b* of the pallet support arm has pads of a low friction material, e.g., plastic pads, that engage and slide along the top surface of the rail that is smooth and extends in an orbital path about the inner frame 27 and past all of the printing stations. As best seen in FIGS. 1 and 14, the rail 142 is supported on vertical legs 142*a* that have leveling pads 142*b* engaging the floor and have lower horizontal legs 142*c* located below the path of pallet travel and connected to the main central frame 27**.

The hollow tubular portion **150*a* (FIG. 13) of the pallet support arm 152 is fastened to an inner, large angle or L-shaped bracket 150*c* of aluminum that has a vertical leg 145 secured by fasteners 144 to the hollow tubular portion 150*a* and a lower depending leg 146. The leg 146 which extends laterally inwardly to be connected to the chain at a position located beneath the level of the pallet, thereby keeping the pallet support arms 152 and the printing heads 18 used therewith at low level for easy use by the machine operator who is applying and removing T-shirts or the like from the pallets 12 on the support arms 152**.

The pallet support arm 152 (FIG. 12) has its inner or rear end 154 connected to the chain by two pins 156 and 158, which are secured to the chain and which project upwardly into openings 160 in the arm. Each pin carries an elastomeric bushing 162 that is compressible by its associated pin, and expands after the pin compressing force is released. In conventional oval printing machines, a notch is provided on each end of the pallet and inner and outer movable locators are each pivoted into engagement with these notches to center the pallet arm between them. In these prior art machines, the pallet is fixedly bolted to the support arm to shift with the support arm. The substrate is fixed on the pallet and hence, shifts with the support arm. The amount of registering movement is limited by the amount of compression of the elastomeric bushing by the pin. In these conventional machines, the amount of registering movement is quite small; i.e., about only 0.0625 inch or less.

In accordance with the present invention, the pallet support arm 152 remains stationary during registration; and the pallet 12 is floated on the pallet support arm with the pallet being shifted in or out and left or right across the pallet support arm during registration. Because there is no compression of the elastomeric bushing 162, the amount of compression of the bushing available is not a limiting factor as in conventional machines. Further, the stretching of the chain or its becoming loose or worn and changing the position of the pallet support arm 152 relative to the printing heads 18 is immaterial because the pallet floats on the pallet support arm, which may shift with such changes in the chain position without adversely affecting the registration of the pallet.

Herein, the pallet 12 is releasably clamped or interlocked with the pallet support arm 152 between registration operations and is unclamped from the pallet support arm 152 to allow shifting of the pallet during a registration operation. The clamping is achieved in this instance by a slidable clamp or latch 164 (FIGS. 13 and 19) on the pallet support arm 152 which is shifted by an actuator or a locator 166 (FIG. 14) between a clamped, interlocked position (as shown in FIG. 14), and a release position wherein the pallet floats for registration by an actuator 163. The preferred actuator 163 is also a locator that shifts the pallet 12 and pushes it against the biasing force of a spring 168 urging the pallet into the clamped position.

Figure 15:
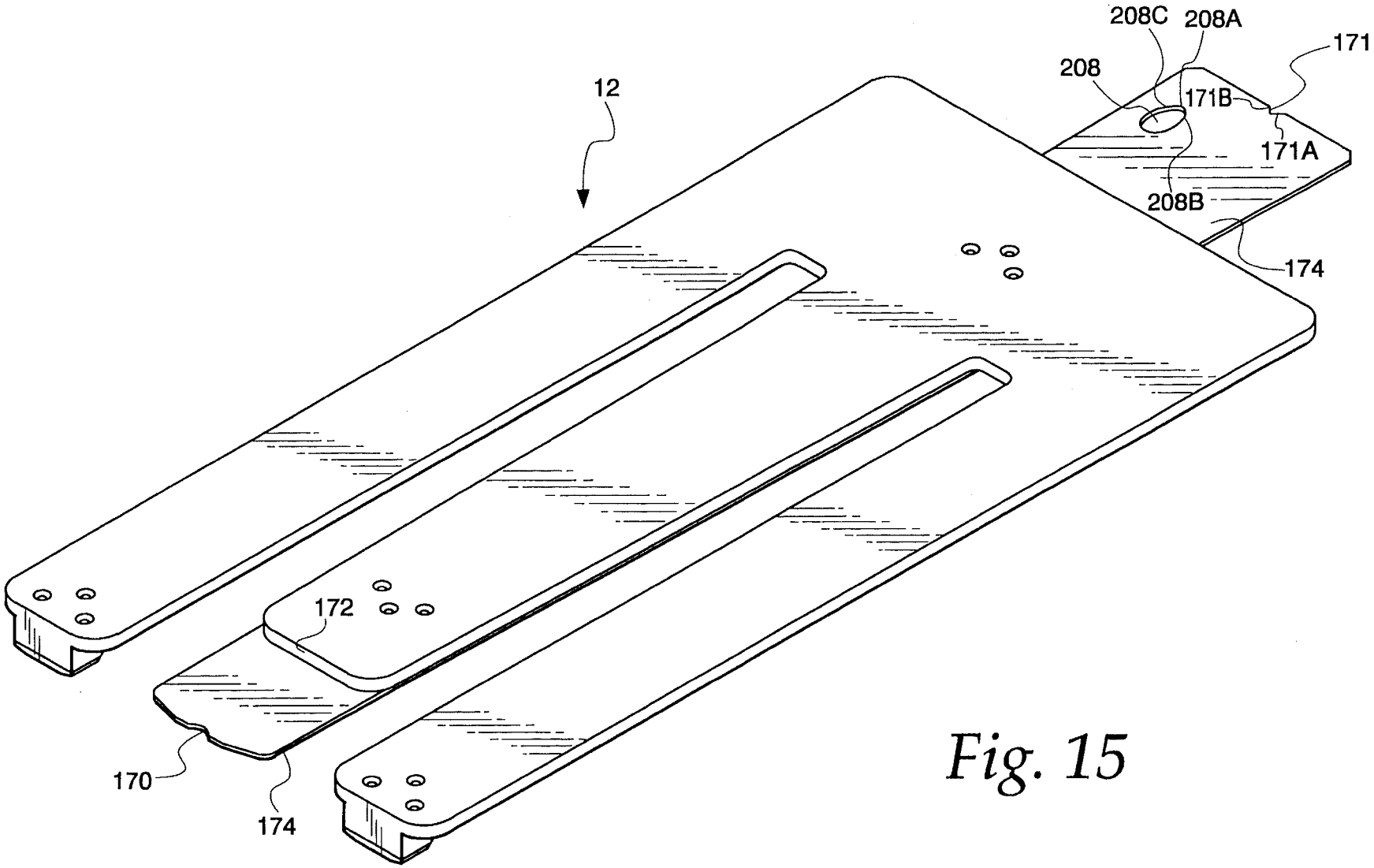
FIG. 15 is a perspective of a pallet for printing on sleeves of a T-shirt.

The illustrated pallet (FIG. 15) includes a pair of locating notches 170 and 171 at inner and outer ends of the pallet 12. The preferred pallet includes a strong honeycomb support body 172 on which the substrate is mounted and an underlying, thin metal plate 174 (FIG. 15) having the notches 170 and 171 at its opposite ends. On the underside of the pallet are first clamping or latching members 176 (FIGS. 16–18) in the form of depending projecting disks or lugs 178 and 179 at spaced locations for insertion into openings 180 and 181 (FIG. 12) in an upper face or side 182 of the pallet support arm 152.

Figure 18:
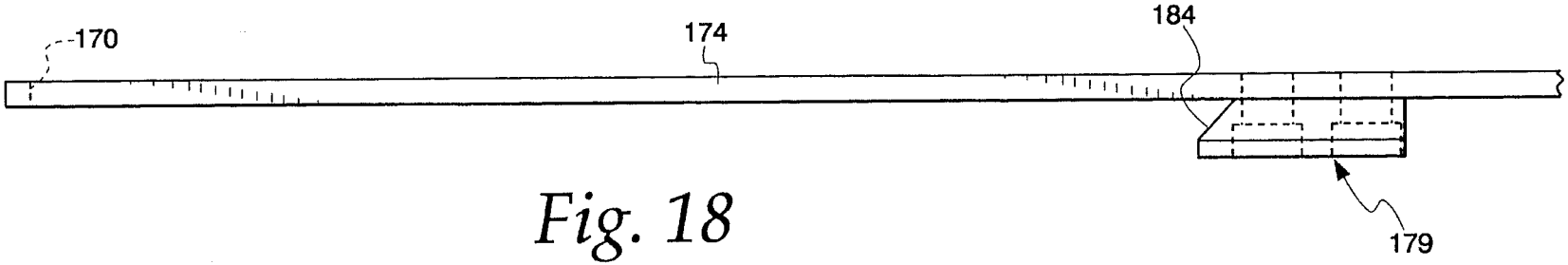
FIG. 18 is an enlarged, fragmentary, front elevational view of an outer locking disk mounted on the pallet plate.
Figure 19:
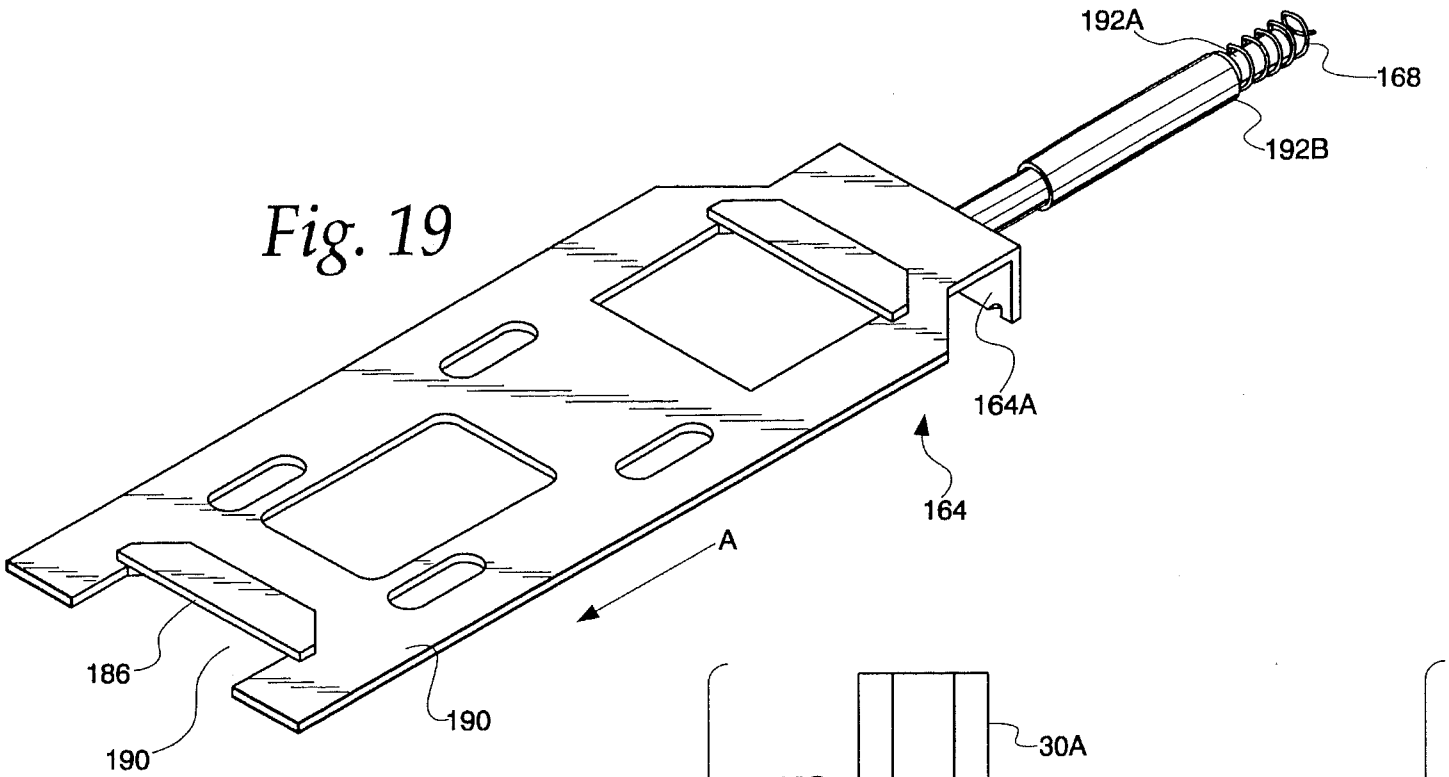
FIG. 19 is a perspective of a latching or clamping member.

As best seen in FIG. 18, the front clamping member 179 is located on the underside of the thin pallet plate 174 and is formed with an undercut or downwardly and forwardly stopped shoulder 184 that is spring urged by the latch 164 to hook under the front edges 181A and 181B (FIG. 12) in the top side or plate 182 of the hollow pallet support arm 152. As best seen in FIGS. 13 and 19, the spring force from the latch spring 168 is directed in the direction of arrow A to push the pallet outwardly toward the rail 142. An upwardly projecting latch flange 186 on the slidable latch or clamp 164 (FIGS. 13 and 19), which is mounted within the hollow interior in the inner portion of the pallet support arm 152, is aligned with and positioned to slide rectilinearly to hook the rear clamp disk 178 which has a ledge 178A receiving the latch flange 186 therein.

The slidable latch 164 has a substantially flat, horizontal, sheet metal body 190 with the latch flange 186 upstruck from the sheet metal body at an opening 190A in the latch body 190. The slidable latch 164 is guided for rectilinear travel within the pallet support arm 152 by fixedly attached, horizontally extending rod 192 having an outer free end 192A that is reduced in diameter and that has a shoulder 192B against which is abutted one end of the compressed, coiled spring 168. The other end of the spring abuts the interior of the vertical wall 145 on the pallet support arm 152. The spring 168 is relatively strong and it urges the slidable latch 164 to keep the flange 186 hooked into the rear clamping lug 178 which has a slot 198 (FIG. 17) above the ledge 178*a* of the rear clamping lug 178 on the pallet plate 174 and to push this pallet plate to the left, as viewed in these FIGS. 12–18. This retains the front clamping lug 179 with its inclined front edge shoulder 184 hooked under the edges 181A and 181B (FIG. 12) of the top sheet metal side 182 of the pallet support arm 152.

Figure 12:
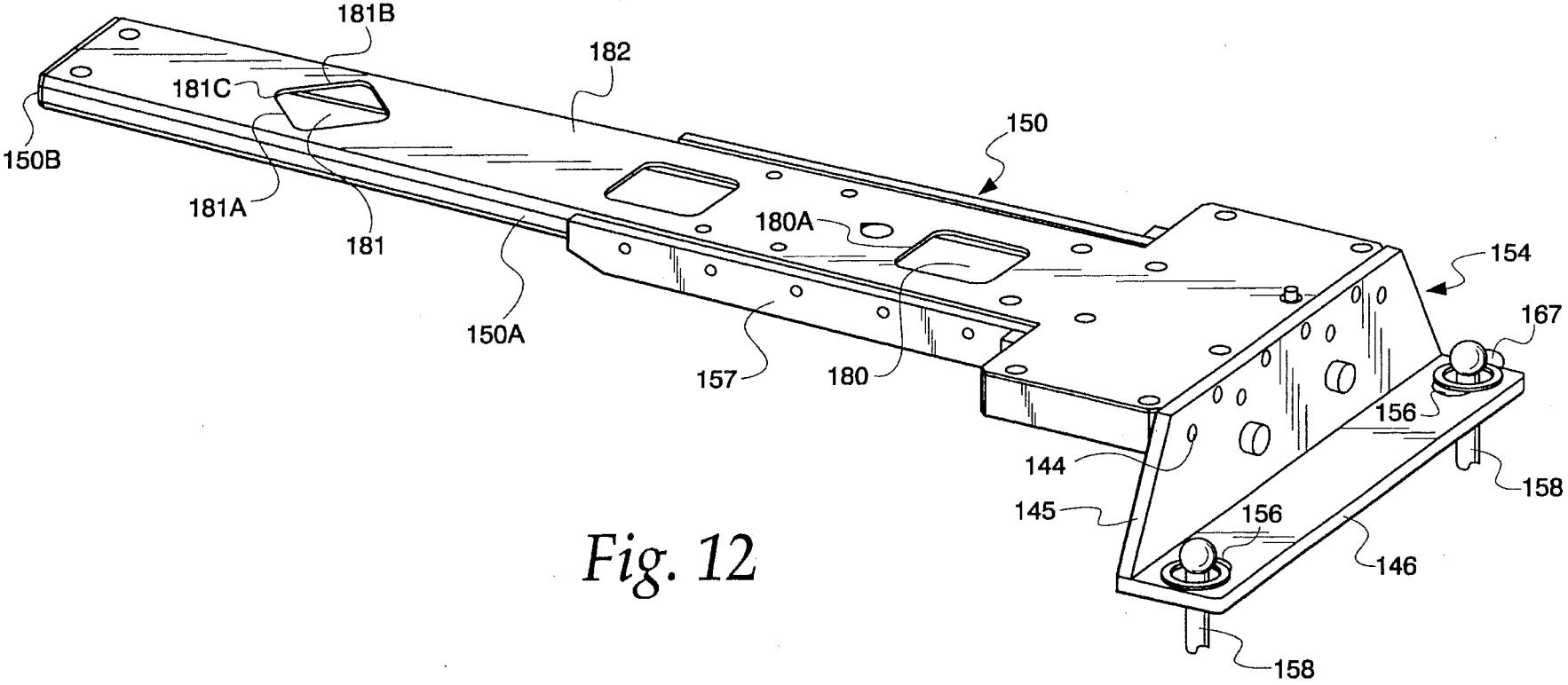
FIG. 12 is a perspective view of the pallet support arm.
Figure 13:
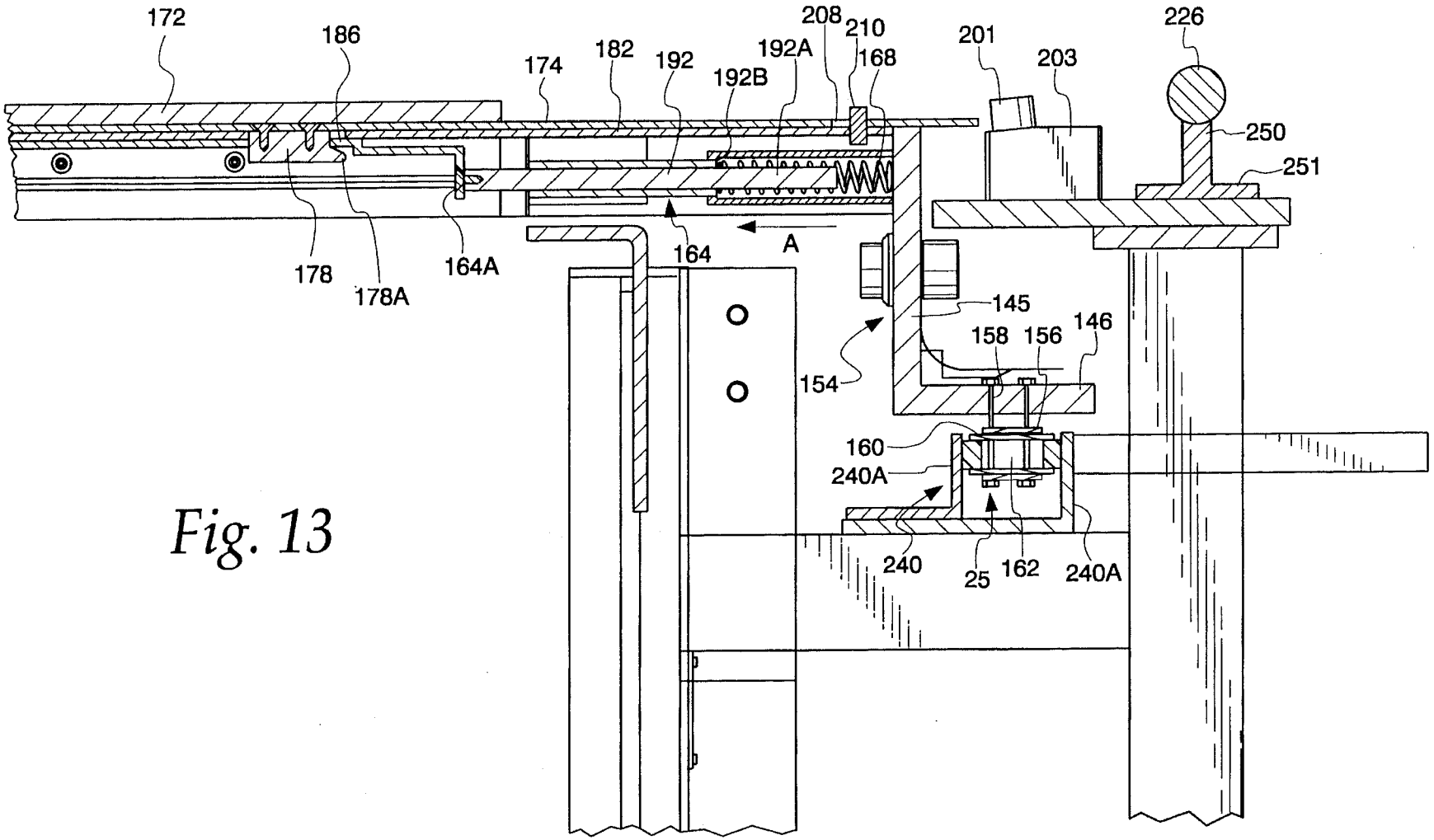
FIG. 13 is an enlarged, fragmentary cross-sectional view of the clamping device for the pallet mounted on the pallet support arm.
Figure 16:
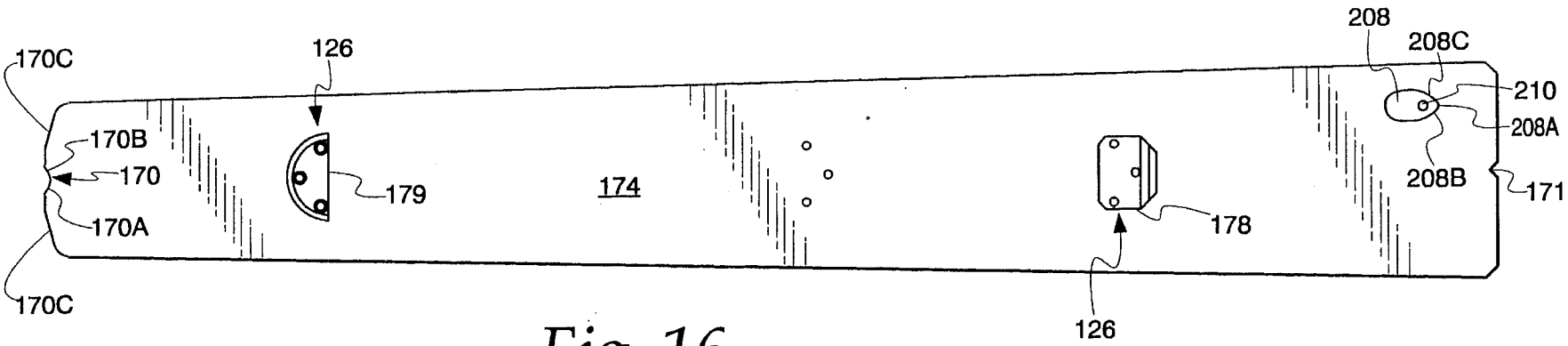
FIG. 16 is a bottom view of a pallet plate with clamping disks thereon.
Figure 17:
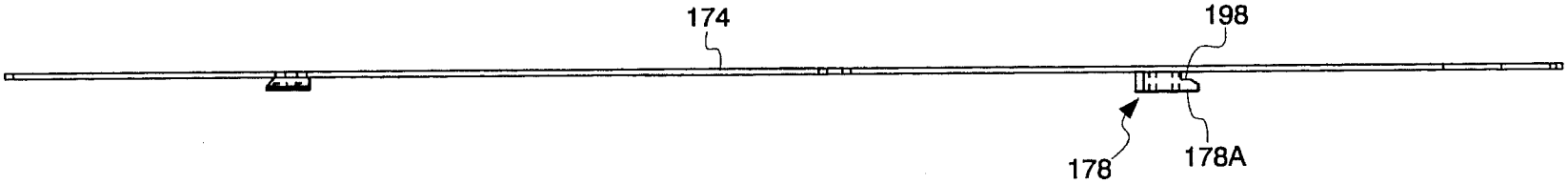
FIG. 17 is a front elevational view of the pallet plate of FIG. 16.

The front latching disk 178 has a semi-circular front portion, as best seen in FIG. 16 that is inclined as seen in FIG. 18 to slip under the top plate 182 of the support arm 152 at the front opening 181 (FIG. 12). This inclined, semi-circular, disk edge 184 engages under one edge 181A (FIG. 12) in the opening 181 and the other side 181B of the opening 181. When so engaged, the center of the disk edge 184 is spaced from a central corner 181C of the diamond shaped opening 181, which is centered along a center line of the support arm's top face 182. Thus, the sloped edges 181A and 181B tend to center the pallet plate 174 and its front notch 170 on the center line of the pallet support arm so that the front, pivoted locators 163 at each of the printing stations 16 will engage a sloped wall 170A or 170B (FIG. 16) of the notch 170, rather than an outer end surface 170C on either side of the notch 170. The edges 181A and 181B thus center the front disk edges 184A and 184B and limit either right or left movement of the front end of the pallet plate 174, as would cause the locators 163 to miss the notches 170 during the registration operations.

While this engagement would limit the outward travel of the pallet 12 by the latch spring 168, it is preferred that outward sliding of the pallet 12 on the support arm 152 be limited by a tear-shaped slot 208 (FIG. 16) having its rear, narrow end wall 208A abut a pin 210 on the arm. The sloped sides 208B and 208C of the tear-shaped slot 208 serve to center the inner end of the pallet 12 on the mid-line or central axis of the pallet support arm 152. Thus, both the inner and outer ends of the pallet 12 are centered and positioned properly. The pin 210 projects upwardly in the tear drop slot 208; and when it abuts end 208A of the slot, it limits the outward movement of the pallet by the biasing force of the latch spring 168. Thus, each pallet is positioned on its pallet support and interlocked therewith at a position to be engaged by the movable locator 163.

Figure 22:
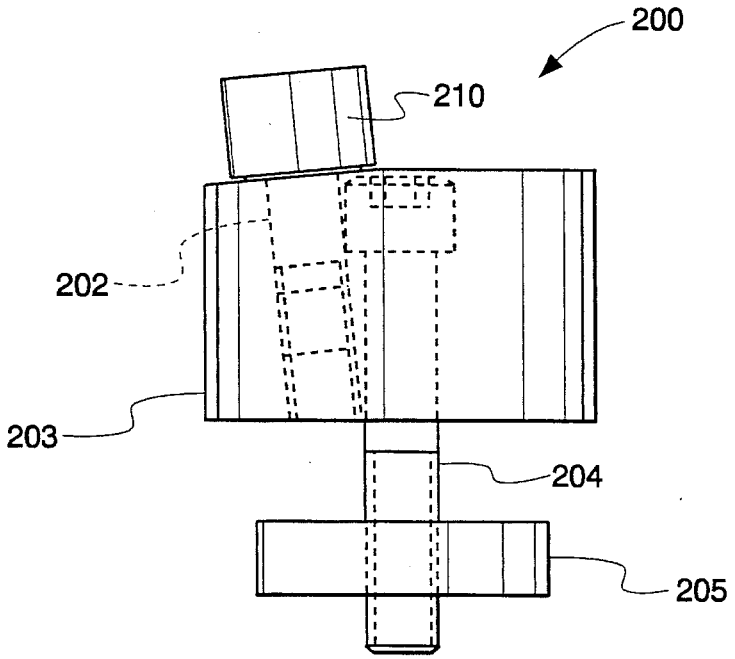
FIG. 22 is an enlarged side elevational view of a stationary, inner locator for the pallet.
Figure 21:
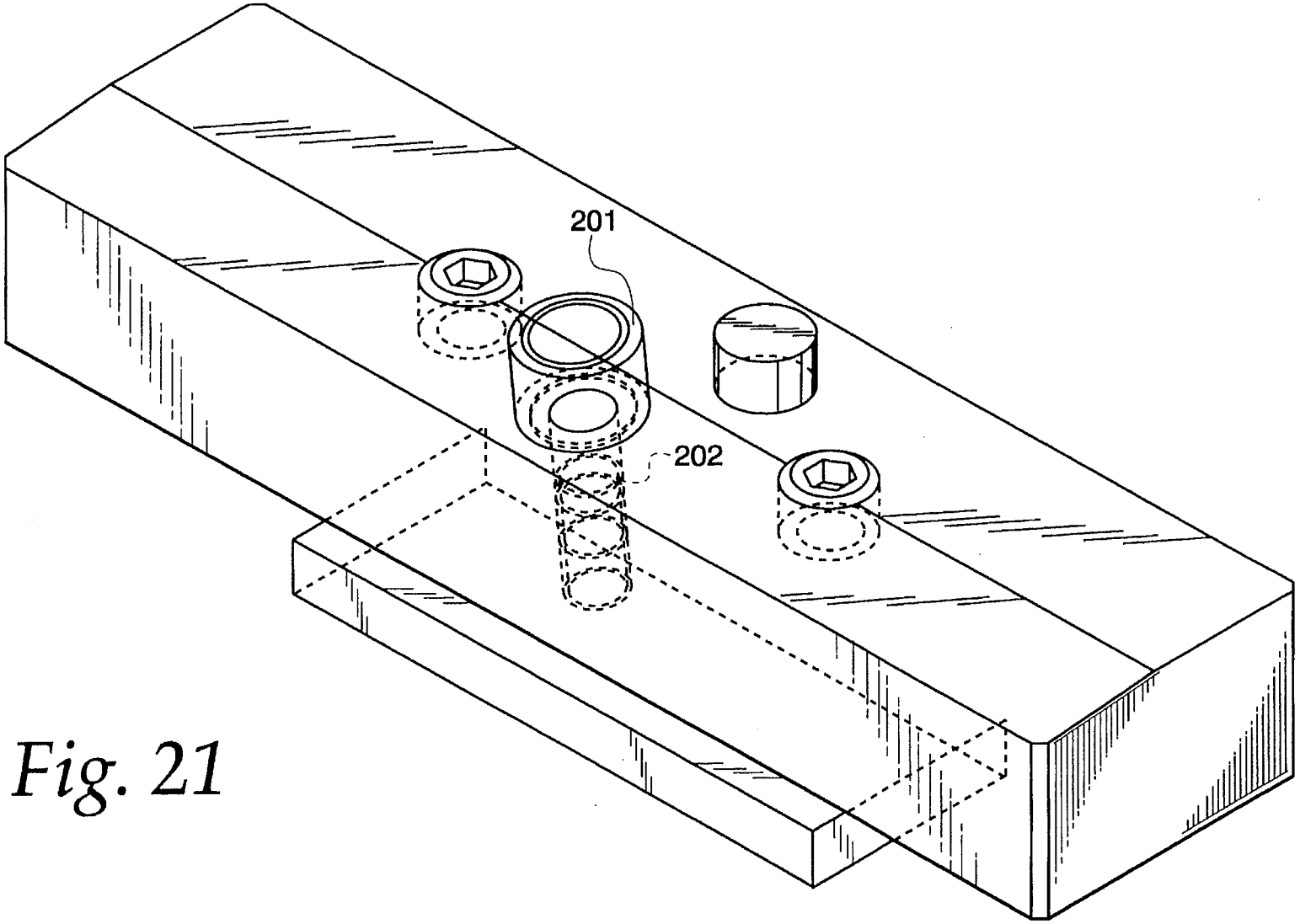
FIG. 21 is a perspective view of the stationary inner locator mounted on a support.

The inner locator 200 for locating the inner notch 171 on the pallet 12 is a fixed, stationary locator that has a roller bearing 201 (FIGS. 21 and 22) mounted for rotation on an inclined post 202. The post is mounted in a stationary block 203 which is bolted to the frame by a bolt 204 threaded into a horizontal frame member 205 of the main central frame of the machine. The side edges 171A and 171B (FIG. 15) of the notch 171 in the pallet plate may engage and rotate the bearing as the floating pallet 12 is shifted during registration. The floating pallet is held and forced downwardly against the upper face 182 of the pallet support arm by the inclination of the axis of the roller to the vertical. At the other end of the pallet plate 174, the other locator 163 is pivoted downwardly and inwardly to hold the floating pallet tightly against the pallet support 150 at the time of registration and during the subsequent printing operation. Thus, the pallet is located in three dimensions—left and right, inwardly and outwardly, and vertically by the inclined locators 163 and 200.

Figure 20:
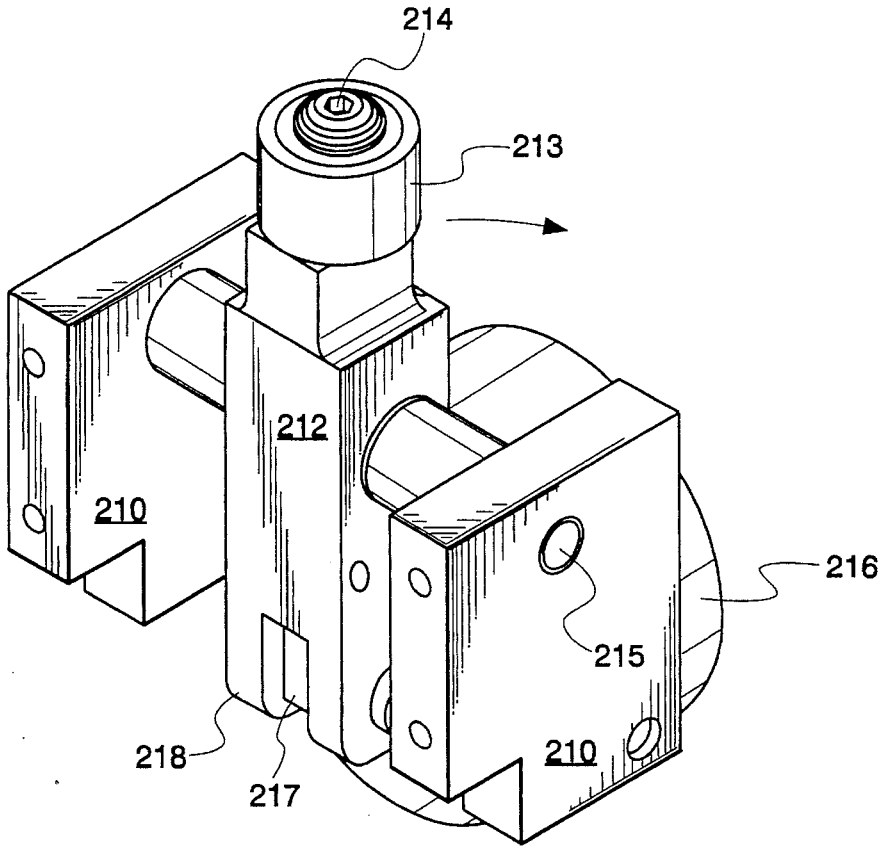
FIG. 20 is an enlarged perspective of a motorized outer locator for the pallet.

Outer locators 163 are mounted on the outer stationary rail 142 at each printing station 16. The locator assembly shown in FIG. 20 comprises a pair of mounting blocks 210 which pivotally mount a lever 212 carrying a locator bearing 213 on its upper end. The bearing is rotatable about a vertical axle pin 214 carried in the top end of the lever. The lever pivots about a horizontal pivot pin 215 spanning the blocks 210. A wide, flat air cylinder 216 is mounted on the blocks with a piston rod 217 connected to a clevis end 218 at the bottom of the lever. As the piston rod moves in and out, the lever is rotated. The air cylinder is relatively large and the air pressure used is sufficient not only to push the pallet 12 along the top surface of the pallet support 150 but also to overcome the opposing force of the latch spring 168.

It is common for pallets 12 to be attached to their pallet support arms 152 by bolts or screws or the like that require tools and take considerable time to unfasten the fasteners and to remove the pallets and then to screw or bolt the bolts or nuts to secure the new pallet in place. This results in valuable down time of an hour or more for machines which have a large number of pallets. In accordance with the present invention, the pallets 12 may be released quickly without the use of manually-operated tools and threaded fasteners. This is achieved by the use of a power actuator 220 (FIG. 9) which will engage the latching or clamping member 164 and shifted it to a release position to remove the flange 186 from engagement with the clamping disk 178 on the bottom plate 174 of the pallet.

Figure 9:
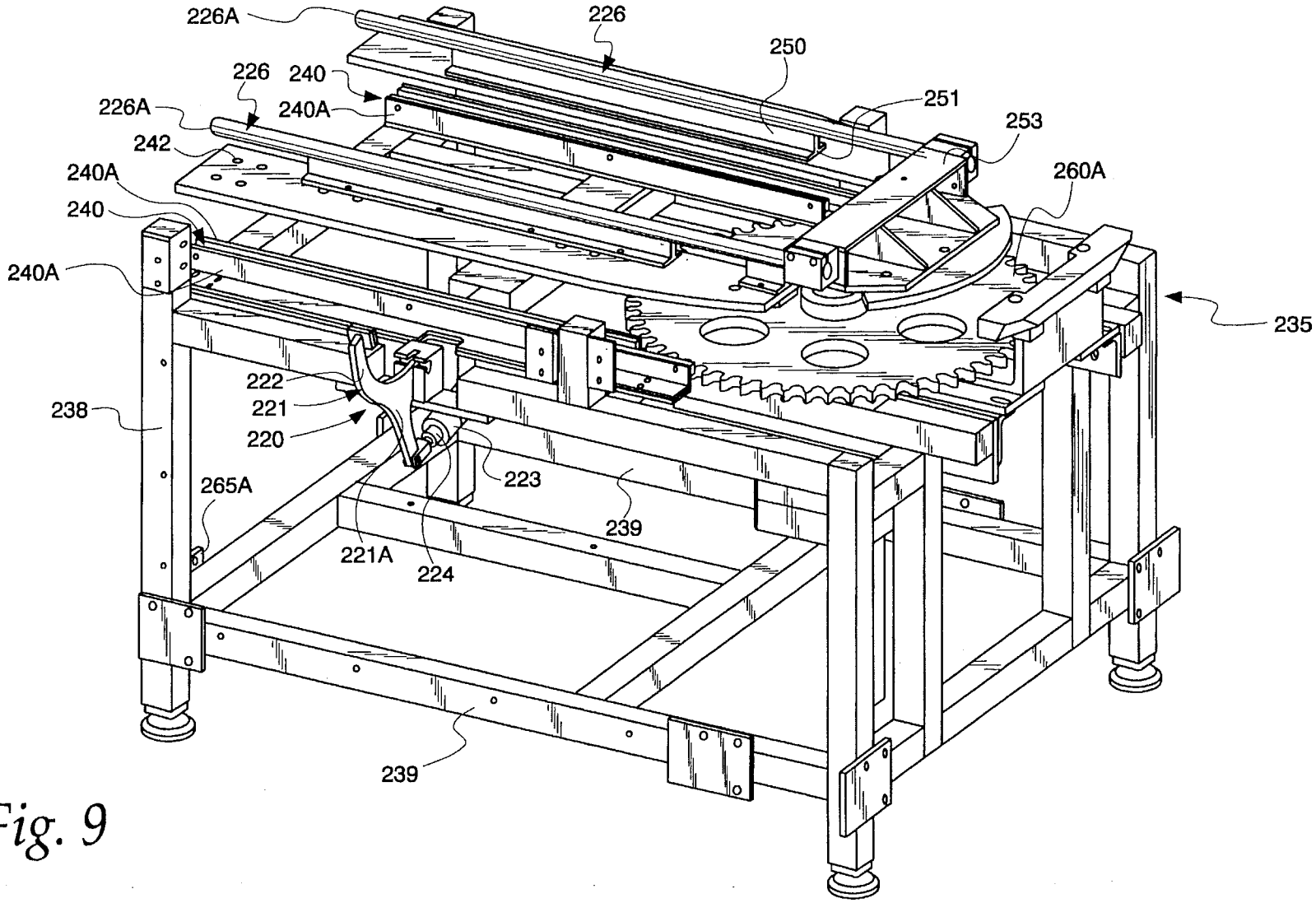
FIG. 9 is a perspective view of the idler end, module of the frame.

More specifically, as best seen in FIG. 9, the power actuator 220 comprises a pivoted lever 221 mounted on the machine frame 27 and having an upper lever end 222 located beneath the pallets as they travel past one end of the machine. An air cylinder or motor 223 is operated to shift its piston rod 224 and clevis thereon to pivot a lower end 221*a* of the lever 221 outwardly to pivot the lever about a pivotal axis at a central pivoted portion 221*b* of the lever. As the lever 221 pivots, its upper end swings through an upward arc to abut a depending leg 164*a* (FIGS. 13 and 19) of the latch member on a pallet support arm 152 positioned over the lever, and the upper end of lever pushes this latching member inward toward the central stationary frame 27 thereby removing the flange 186 from the clamping disk 178 on the bottom of the pallet. Then the operator manually slides the pallet inward so that the outer disk's inclined surface 178 clears the edges 181A and 181B in the upper pallet arm side 182, and lifts the clamping lugs 179 and 178 through the openings 181 and 180, and lifts the pallet 12 from the support arm. The operator will then place a new pallet onto the support arm with the new disks 178 and 179 placed in the openings 180 and 181 and reverse the air cylinder 223 to pivot the upper end 222 of the lever down. This allows the spring 168 to push the latch 164 to engage its flange 186 with the disk 178 and push the pallet outward to have the inclined edge 184 on the outer disk 179 engage surfaces 181A and 181B on the pallet support arm, thereby clamping the new pallet to the support arm without the use of wrenches, air-operated screwdrivers or the like. As will be explained, the main controller may cycle the chain intermittently so that a pallet 12 is automatically advanced into position below the actuator 220, and the air cylinder 223 is automatically operated for a predetermined time interval, e.g., a minute, and then the air cylinder is reversed to release the actuator to cause clamping of the new pallet 12 to the support arm. Rather than an automatic operation, a control switch (not shown) may be operated by operator to advance the chain and to operate and release the actuator on an individual, customized time basis.

Figure 2:
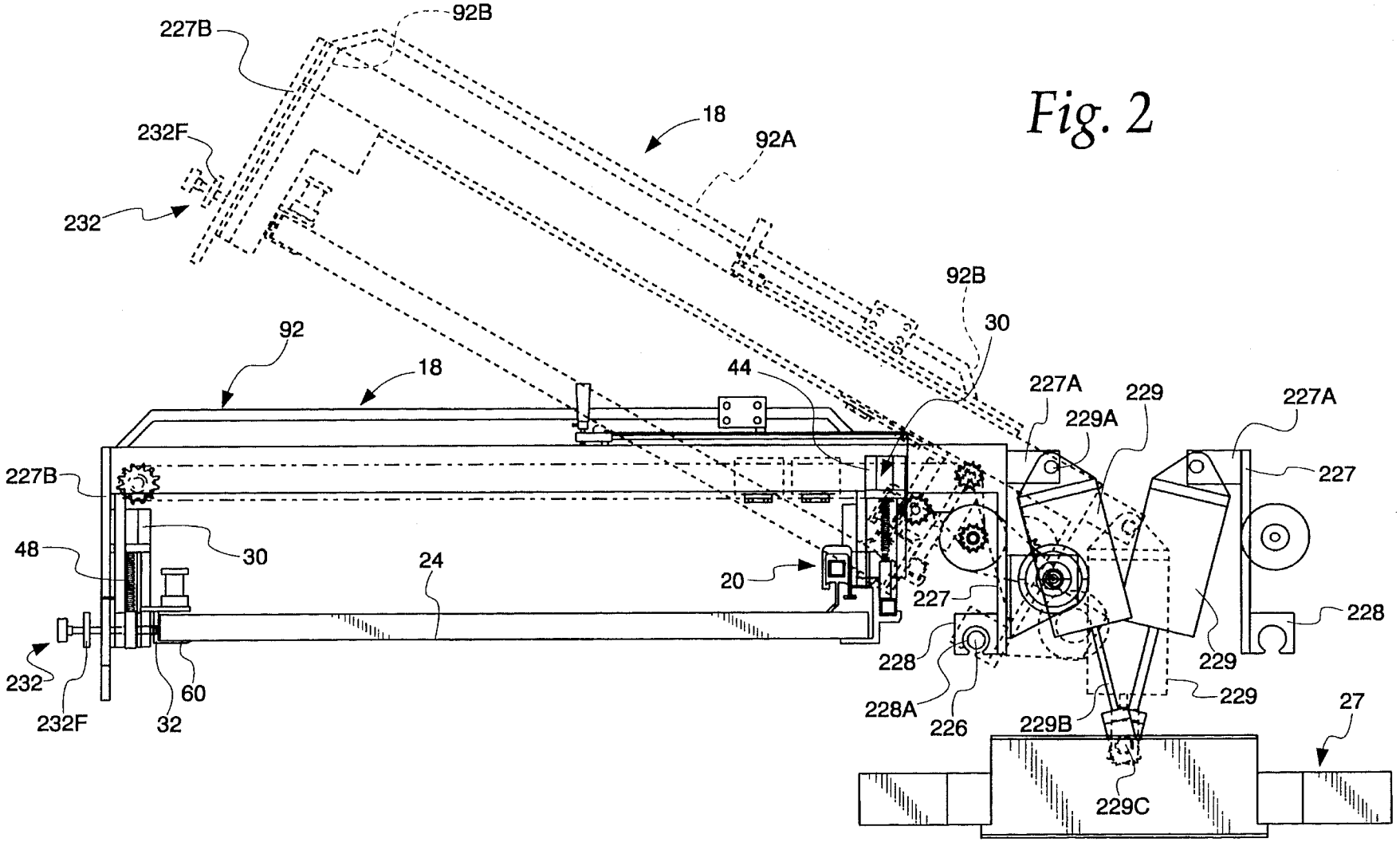
FIG. 2 is a partial elevational view of a printing head in its operative and high lift positions.

The print heads 18 also have a high lift position shown in FIG. 2 in dotted lines which allows the operator to have access to clean the bottom of the printing screen 24. One of the shortcomings of the conventional four post machines in which the screen remains horizontal and is not pivoted upwardly at an incline is that it is difficult to clean the underside of the screen. As shown in FIG. 2, the illustrated printing head 18 can be pivoted upwardly about a horizontal pivot rod 226 which is located at the inward side of the print head. The pivot rod is secured to and extends parallel to and along the top of the inner machine frame 27, as best seen in FIG. 9.

There are a pair of parallel pivot rods 226 on opposite sides of the frame 27 to mount print heads pivotally on both sides of the frame 27. The printing heads 18 are formed with a rear vertical wall 227 that carries at the lower end thereof a pivot mounting block 228 (FIG. 2) having bushings 228A therein encircling the pivot rod 226.

The print heads 18 are pivoted to their open, high, lift positions by a powered means, preferably in the form of an air cylinder 229 (FIG. 2), having connected at its upper end to the print head by a pivot pin 229A and connected at its lower end by its piston rod 229B and pivot pin 229C to the frame 27. The upper pivot pin 229 is connected to a bracket 227A fastened to the upper end of the rear wall 227 of the print head at a location slightly inward of and substantially above the pivot rod 226. Thus, powering of the air cylinder to retract the piston into the cylinder, as shown in dotted lines in FIG. 2, pivots the print head to its raised position for cleaning the screen or to disable the print head when it is not to be used for a particular printing job. Also, when using all around pallets for printing on the extended sleeves as well as the body of the T-shirt, adjacent print heads will be lifted because the pallet is wider, e.g., 54 inches, than the spacing, e.g., 36 inches, between adjacent printing heads at adjacent printing stations. This allows an operative print head to use a very wide pallet that would otherwise interfere with an adjacent print head if the latter were not kept in a high lift position.

Figure 23:
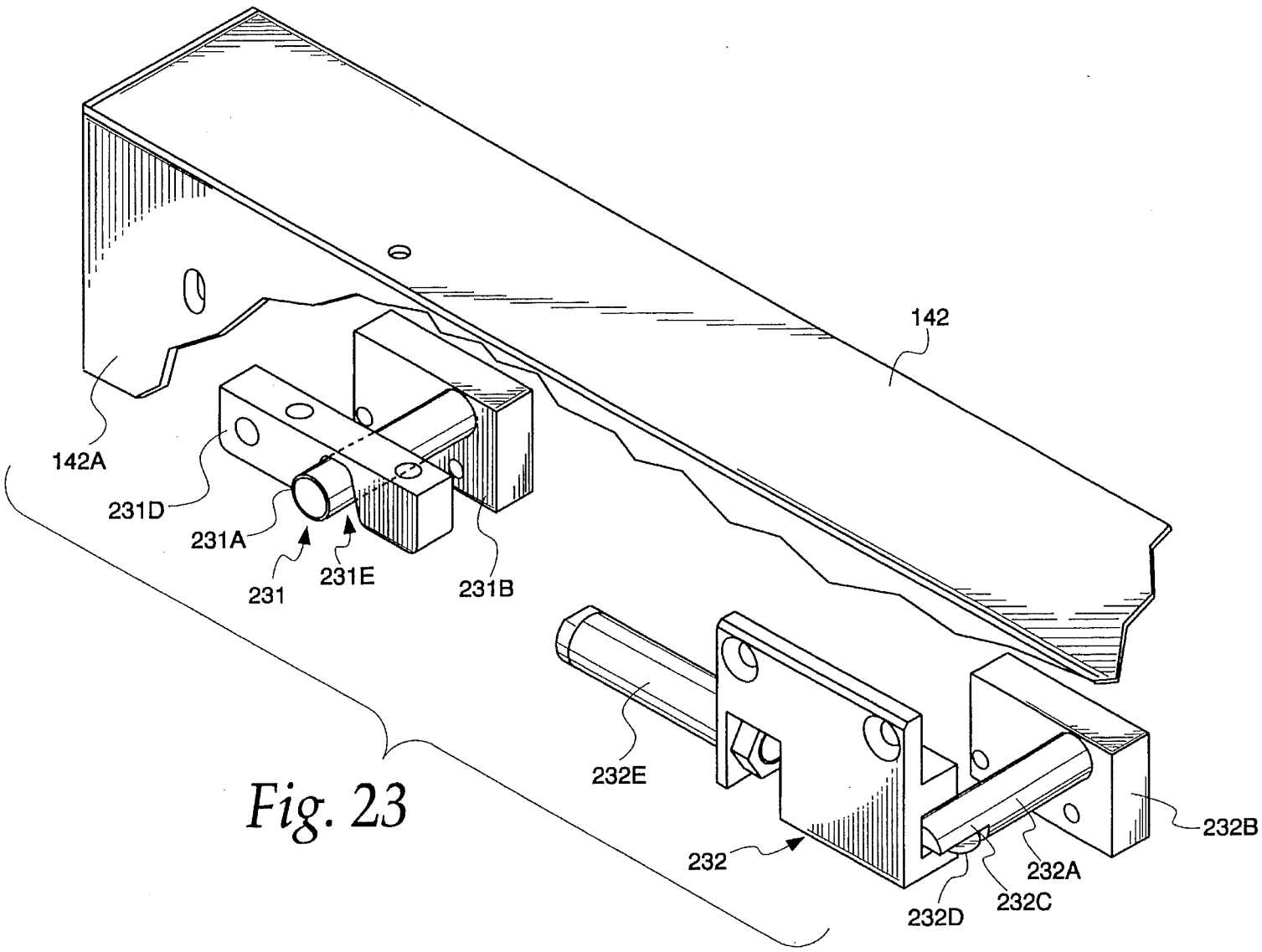
FIG. 23 is a perspective of a device for latching and locating the screen printing head in its printing position.
Figure 25:
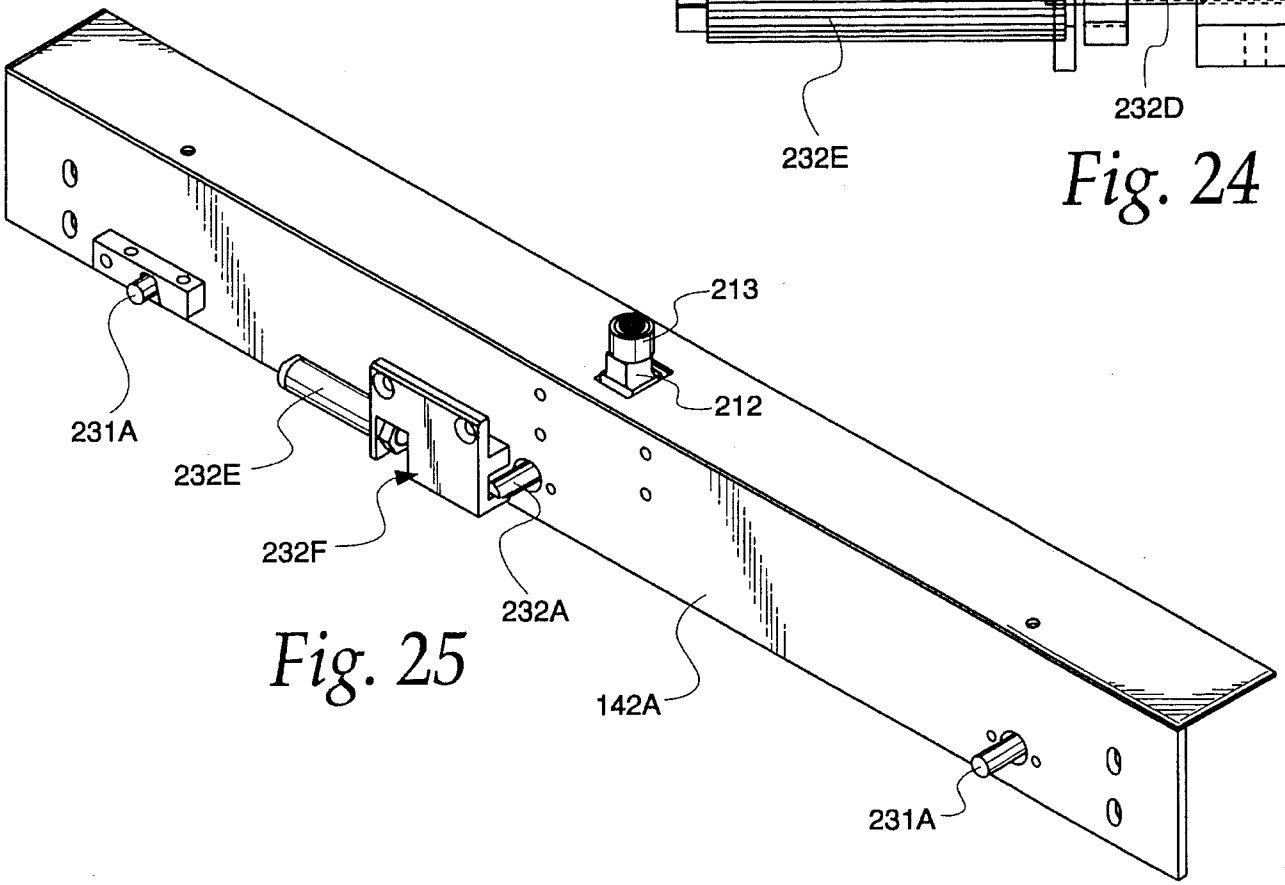
FIG. 25 is a perspective of a portion of a rail having a print head latching mechanism and pallet locator.

When the printing head is pivoted down to its position for printing, it is automatically centered or registered on the outer encircling rail 142 by a locating means 231 (FIG. 23) and latched against upward movement by a latch means 232. The locating means comprises a pair of horizontal, cylindrical posts 231A (FIG. 25) that have inner ends fixed to the encircling rail 142 and project outwardly through openings in a depending flange 142A on the rail 142. The printing head 18 carries a pair of locating blocks 231D (FIG. 23) each having a downwardly-facing groove 231E having which has inclined sidewalls 231F that cam against the centering post 231A to shift the head left or right. The downward movement of the printing head is limited by the center, horizontal wall 231G of the groove abutting the top surface of the post 231A. Because there are a pair of spaced locating means 231, the printing head will be centered between them.

Figure 24:
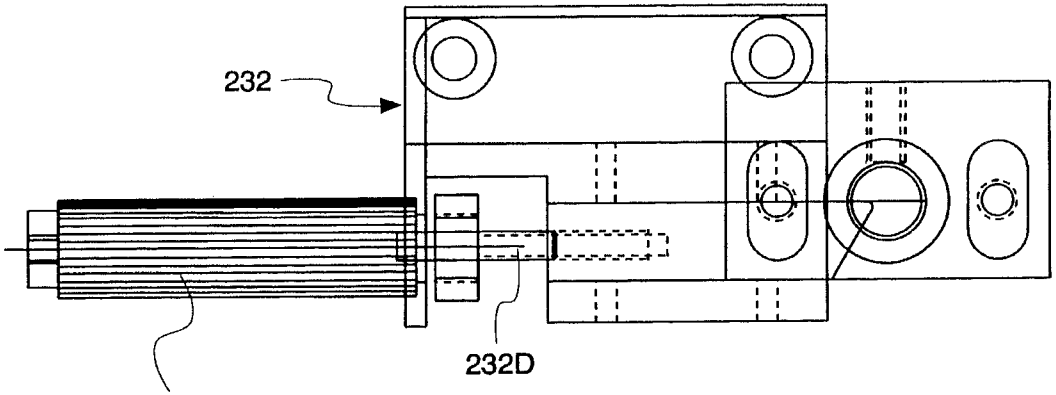
FIG. 24 is a front elevational view of a print head latching mechanism.

The latching means 232 which latches the printing head 18 down comprises a central stationary post 232A (FIGS. 23, 24 and 25) fixed to the stationary, encircling rail 142 by a mounting block 232B. The post 232A projects horizontally outward through an opening in the rail-depending flange 142A. The post 232A has a downwardly-forcing flat 232C at its outer free end that engages a piston rod 232D (FIGS. 23 and 24) when the piston rod is extended from a latching air cylinder 232E. The latching air cylinder 232E is carried in a bracket 232F mounted on a front-depending printing head wall 227B (FIG. 2). The latching air cylinder 232E and the head lifting cylinder 229 are interconnected by air lines and controls so that the latch cylinder 232E is operated first to retract its piston end 232D from beneath the latch post 232A before the lifting cylinder 229 pivots the print head upwardly to the high lift position.

Figure 10:
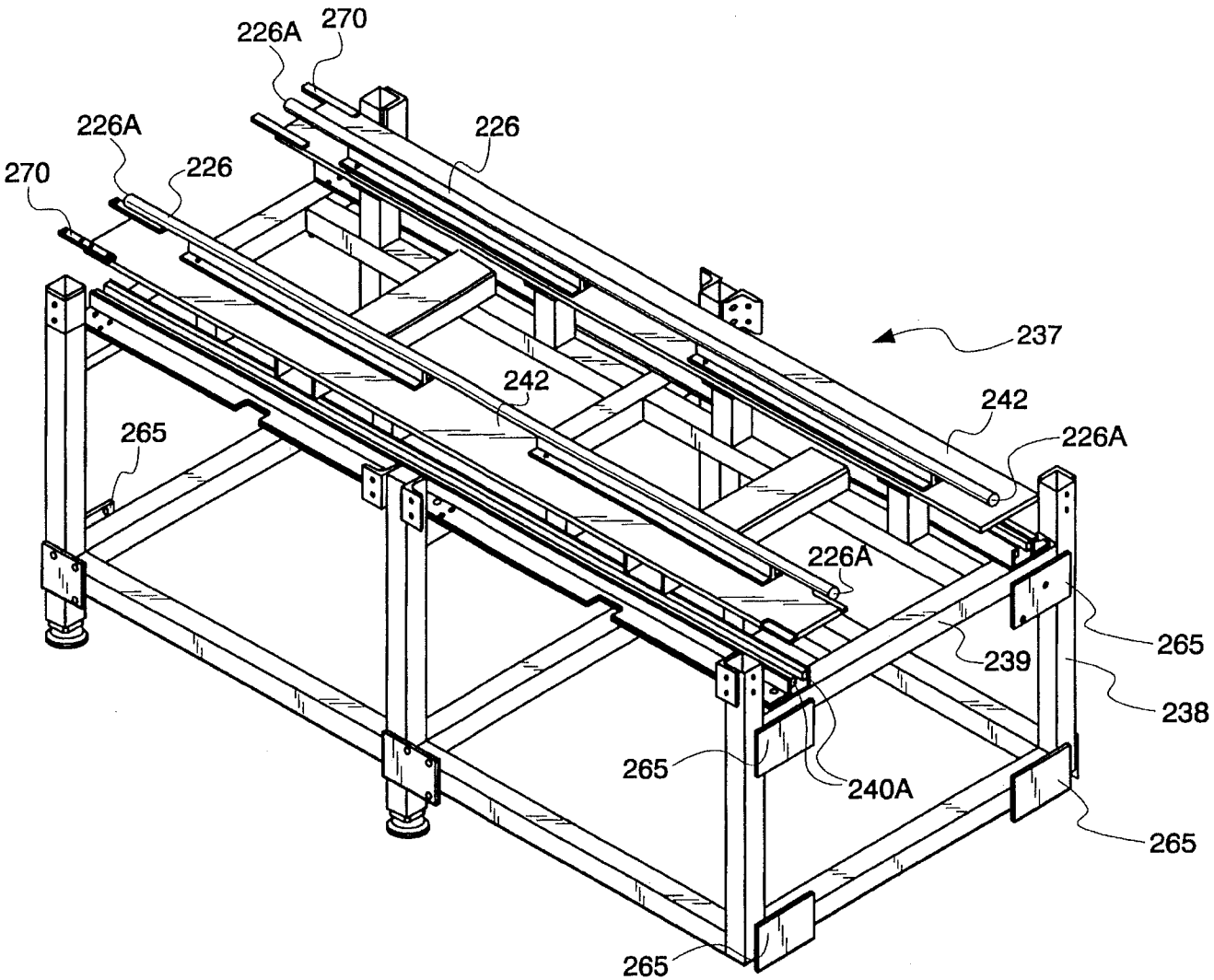
FIG. 10 is a perspective view of the intermediate module of the frame.
Figure 11:
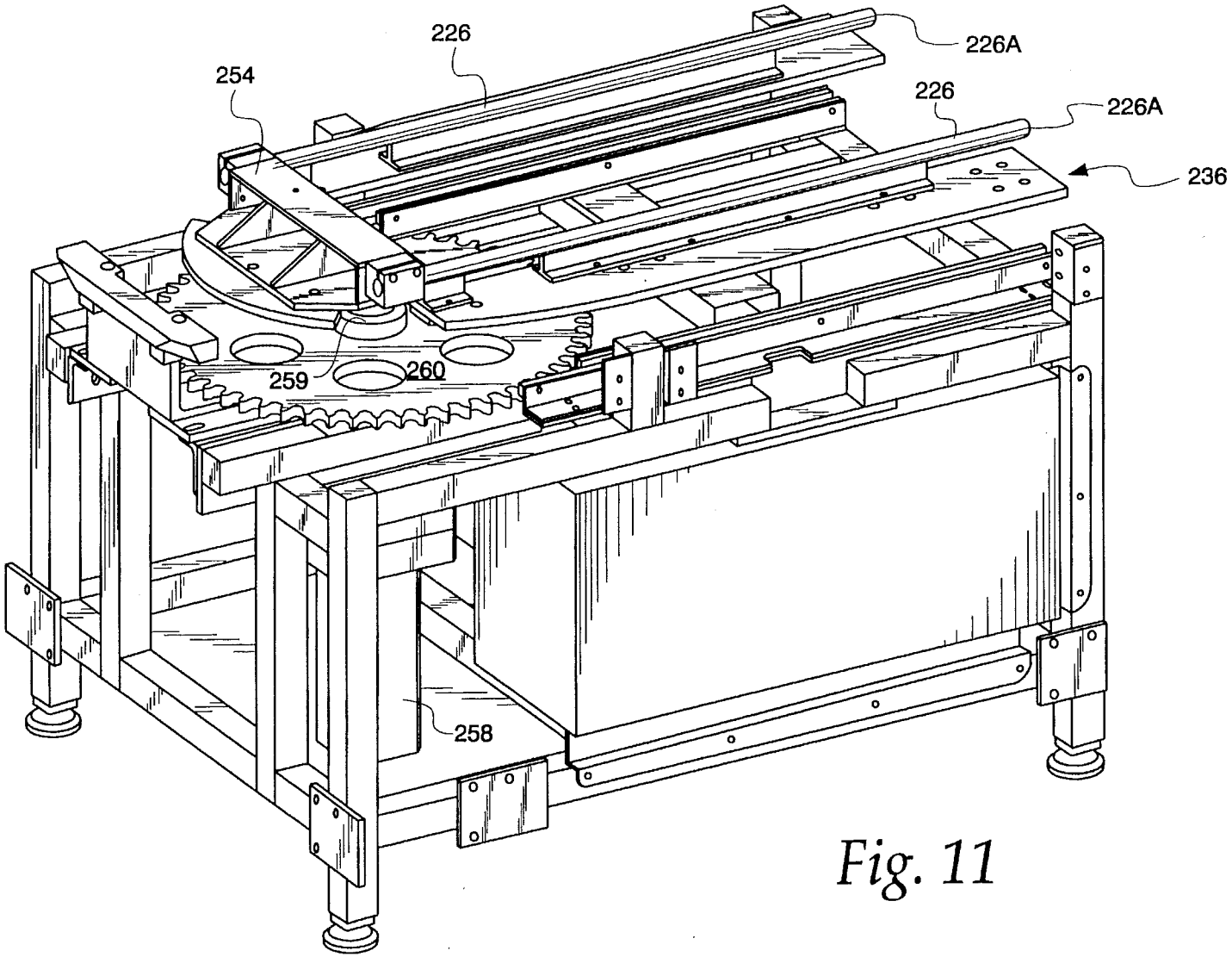
FIG. 11 is a perspective view of the drive end module of the frame.

The printing apparatus is made in modular form with end and intermediate modules or units that are bolted together to form the complete, inner, central frame 27 for supporting the printing heads 18 and for driving the pallets 12 by the endless chain 25. The illustrated apparatus has an idler end module 235 (FIG. 9) and a drive end module 236 (FIG. 11), each of which will have a pair of opposed printing heads 18 thereon, and will have at least one central or intermediate module 237 (FIG. 10) that carries four printing heads 18. Thus, the minimum configuration of two end modules and one central module has ten printing heads thereon for printing one to seven colors. By adding a second intermediate module 237 having four printing heads thereon, the total printing heads is raised to fourteen for printing one to eleven colors. By adding intermediate modules the number of printing heads has been increased to thirty-four heads.

Each of the modules 235, 236 and 237 has a box-like framework of vertical legs 238 and horizontal beams or braces 239 supporting at the upper side thereof a pair of parallel, channel-shaped chain guides 240 (FIGS. 9, 10, 11 and 13) having an upper open side with the chain 25 being guided between a pair of upstanding channel walls 240A. Adjacent the chain guides are flat, horizontal slide plates 242 on which the pallet support arms 152 will slide. The two parallel pivot rods 226 on which the heads pivot are fastened at the lower sides to an upper leg 250 of a T-shaped bar 251 carried by the slide plates 242. The ends of the parallel pivot rods 226 are mounted in cross mount assemblies 253 and 254 (FIGS. 9 and 11) in the respective end modules.

To drive the endless chain 25, the end drive module 236 (FIG. 11) has a drive motor 258 located beneath and driving a shaft 259 with a large chain-driving sprocket 260 fixed to the top of the shaft 259. At the other idler, end module 235 (FIG. 9), a similar sprocket 260A is journaled in the frame 27 to turn about a vertical axis. The endless chain 25 is guided by the chain guides 240 between the sprockets 260 and 260A for travel in a horizontal plane along a forward path and a parallel return path to keep the chain straight and travelling along parallel paths between these sprockets.

In accordance with the present invention, the respective end modules 235 and 236 and the intermediate modules 237 are precisely aligned and kept this way by a novel method of manufacture. The intermediate module 237 (FIG. 10) is provided with connecting members or plates 265 fastened to the frame legs 238 and cross braces 239. A similar array of connecting plates 265A are fastened to the abutting ends of the respective drive and idler modules for being bolted to the plates 265 of the adjacently abutted module.

The head pivot rods 226 have ends 226A that must be abutted and kept on a common axis to allow a pivot head to slide; and chain guides 240 must be aligned so that the chain guide flanges 240A guide the chain 25 smoothly without hang-ups between adjacent modules. This alignment would not be achieved if the modules were separately assembled and then merely abutted at the connecting plates and bolted together. Rather, the respective three or more modules are assembled in one long continuous fixture (not shown). After the frame pieces are assembled; the connecting plates 265 and 265A are then bolted together, and then these bolted plates are welded to adjacent legs 238 of adjacent modules and to adjacent cross braces 239 of adjacent modules. Additional links 270 (FIG. 10) span adjacent ends of the slide plates 242 and are bolted to connect the slide plates on the end modules to the slide plates at opposite ends of the intermediate module. To ship the apparatus, the bolts and nuts are removed from the abutted plates 265 and 265A and links 270, and then the modules are separated and shipped separately. When they arrive at the customer's plant, the plates 265 and 265A are again abutted and the bolts and nuts are again used to connect these plates and links 270 to the modules with the pivot rods, chain guides, etc. aligned as they were in the fixture at the time of manufacture of the apparatus.

The oval screen printing machine of the present embodiment comprises, for example, 18 equally spaced print stations. Each print station may be idle or active and, if active, may include a print head or other equipment such as a flash cure unit. The print stations are at fixed locations around the oval after the printing machine has been constructed and mechanically adjusted. The printing machine includes a series of pallets 12 equal in number to the number of print stations, which pallets are connected by the chain 25 for traveling in an endless path through the print stations. The pallets are equally spaced along the chain so that the individual pallets can be simultaneously placed in registration with individual ones of the print stations during a printing operation.

Figure 28:
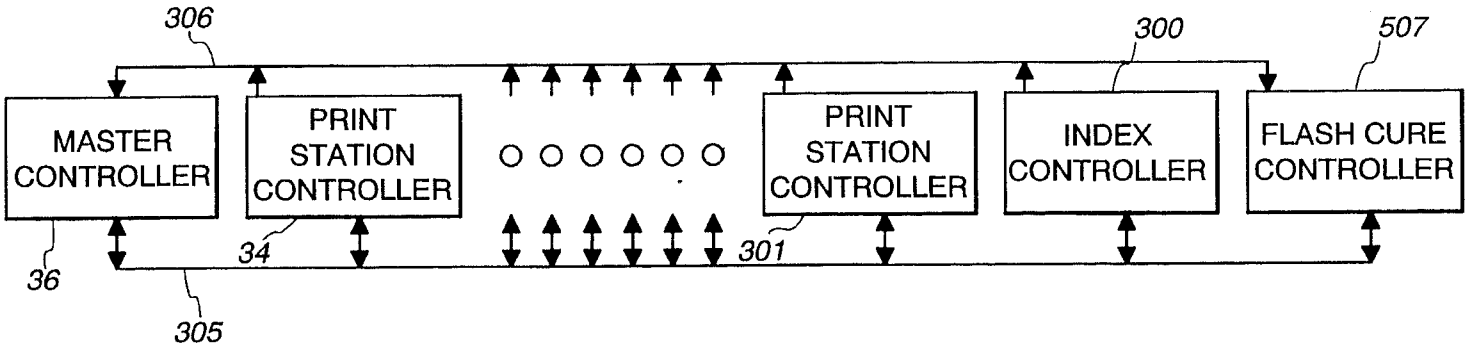
FIG. 28 is a block diagram of the electronic control architecture of the printing machine.
Figure 30:
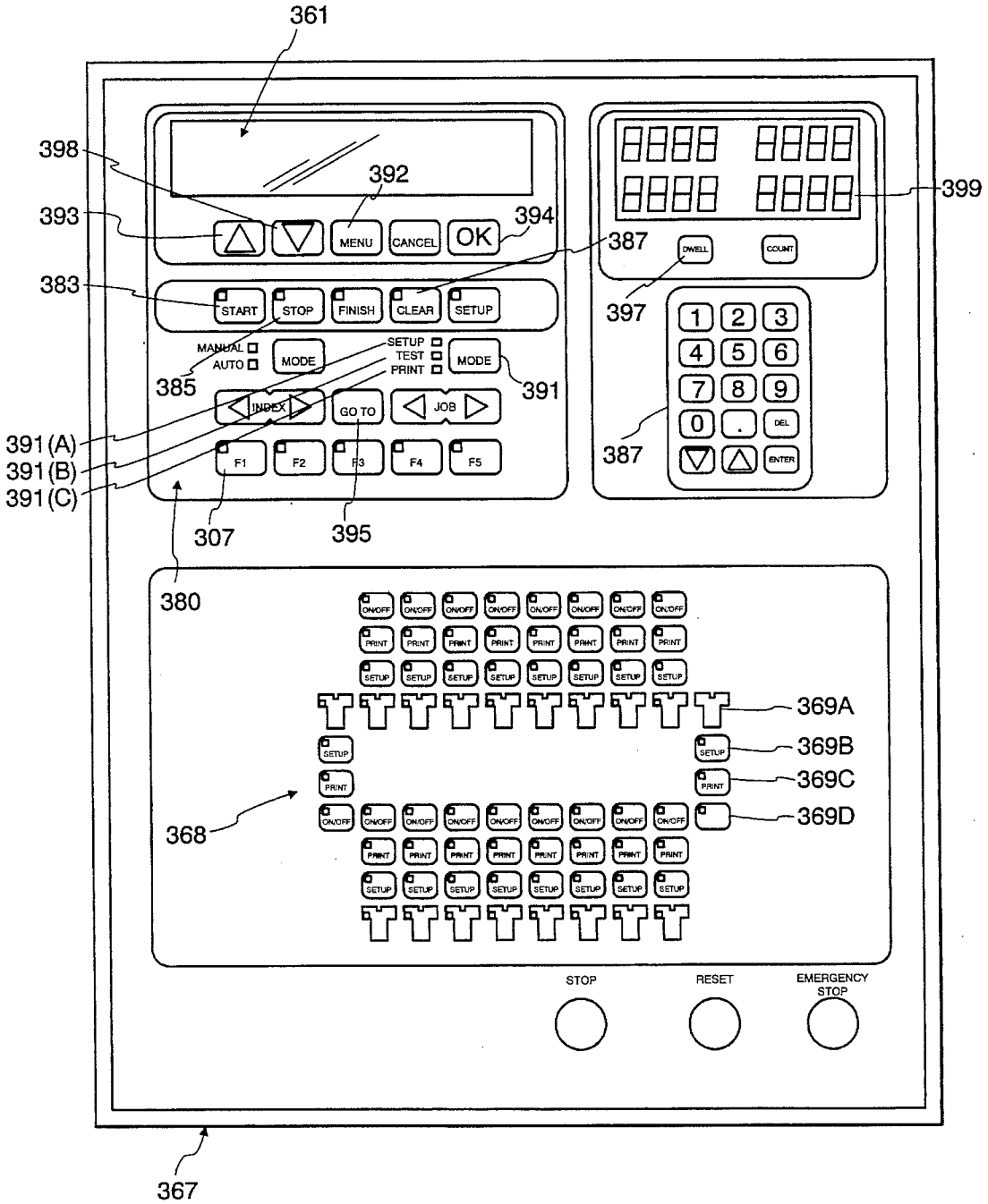
FIG. 30 shows a keyboard/display unit of the master controller of FIG. 28.
Figure 31:
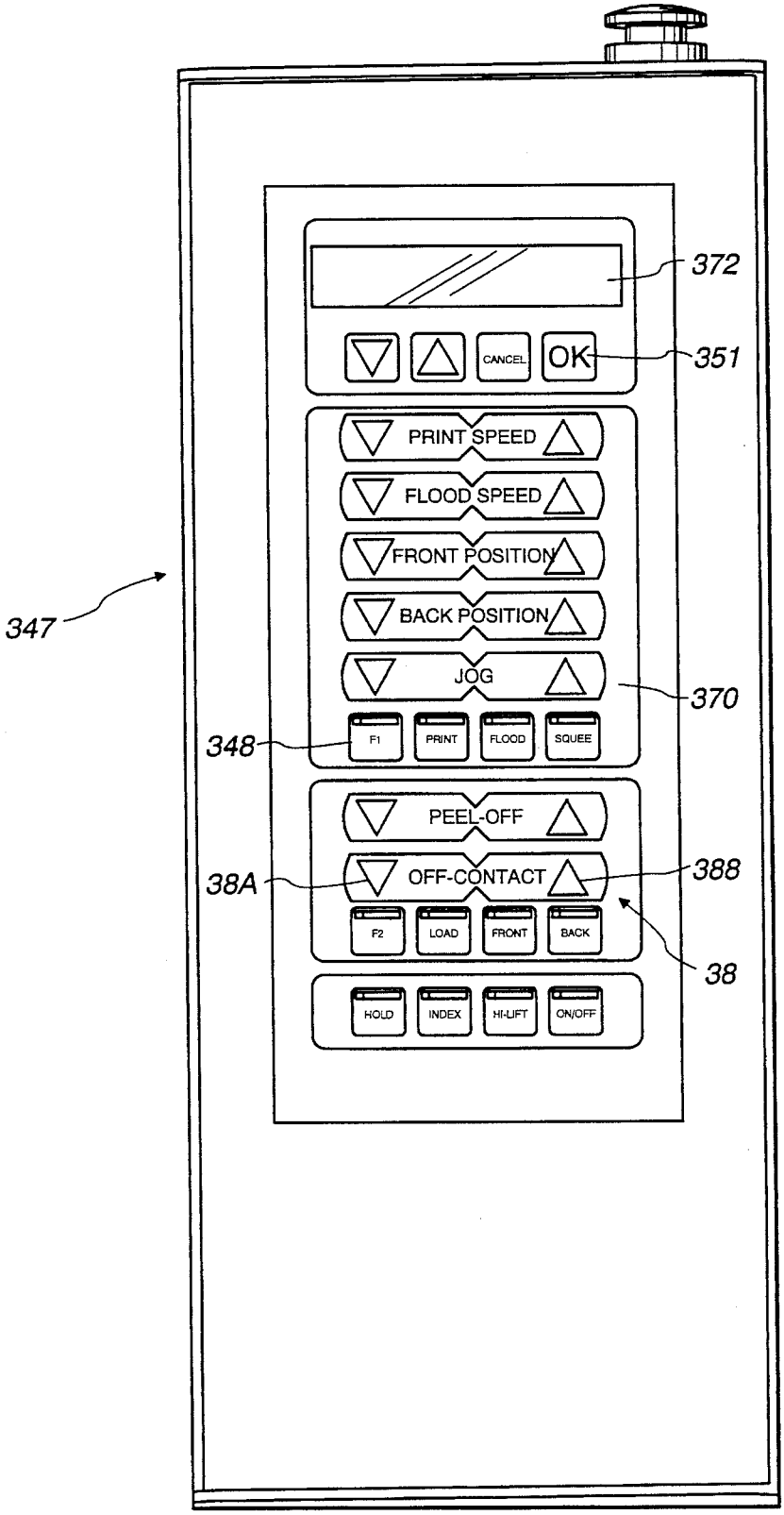
FIG. 31 shows a keyboard display unit of the print controller of FIG. 28.

During normal printing operations the pallets are moved from print station to print station and the are held stationary at the print stations while a printing or other operation such as flash cure occurs. FIG. 28 is an overall block diagram of the electronic control architecture for coordinating the operation of the printing system. The control architecture comprises a master controller 36 which records and maintains overall control of the system, an index controller 300 and up to 18 print station controllers, of which print station controllers 34 and 301 are specifically shown. One or more flash cure controllers, e.g., 507, may also be used. All of the controllers are connected by a bi-directional bus 305 which conveys data between the master controller and the print station, flash cure and index controllers according to the RS485 protocol. The print station controllers 34 and 301, the flash cure controller 567 and the index controller 300 also communicate certain specific information with the master controller 36 over a separate communication bus 306. The information on bus 306 is discussed below. The master controller includes a keyboard/display unit 330 (FIG. 30) and each print station controller includes a keyboard/display unit 347 (FIG. 31).

The master controller 36, the print station controllers 34 and 301, the flash cure controller 507 and the index controller 300, all include a programmable microprocessor of the 8051 type and its usual support apparatus such as memory. The overall coordination of machine operations is synchronized by communication to and from the master controller 36 over the bus 306, which comprises 3 communication lines referred to as a fault line 320, a start line 321 and busy line 322. The start line 322 is controlled by the master controller 36 to signal the beginnings of pre-programmed operations by the various other controllers, such as controllers 34, 301 and 300. When a controller 34, 300, 301 or 507 begins a pre-programmed operation, it transmits on busy line 322 a logic low signal which continues until the controller has completed its operation when the logic low from that controller is terminated. The signals on busy line 322 are common collector signals so that a low level signal from any such controller, e.g. 34, will hold the busy line low until all controllers have released the logic low. The master controller 36 responds to the low level busy signal by preparing for subsequent operations and waiting to send another start signal on start line 321.

Figure 32:
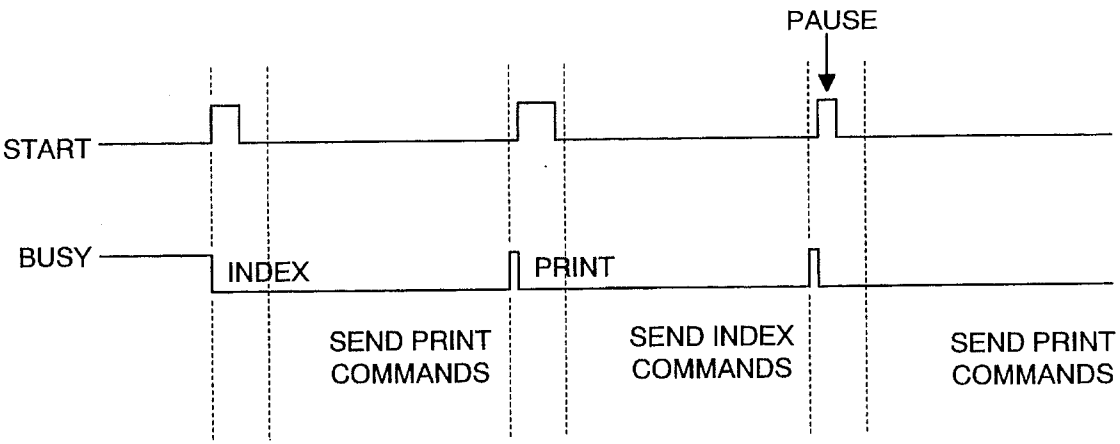
FIG. 32 is a timing diagram of printing machine operations.

FIG. 32 shows the sequence of busy and start signals which are used to operate the printing machine. During normal automatic printing, a cycle consists of alternating index and print portions. The index controller 300 receives data defining its next index operation from bus 305 as a beginning command or during the preceding print portion of a cycle. Similarly, the print station controllers and flash cure controllers receive over bus 305 information to control printing and curing during the next print portion of the cycle. A more detailed description of the printing machines' synchronization is presented with regard to FIGS. 37, 38 and 39.

The series of pallets 12 is moved in an endless loop around the oval by a position controllable servo motor 258 (FIG. 29) which rotates sprocket 260 to drive the chain interconnecting the pallets. The pallets are equally spaced along the chain with spacing which is substantially equal to the spacing between adjacent print stations 16. In the presently described embodiment, the print stations and thus the pallets 12 are separated by 36.25" on center, which distance is referred to as the index length. During normal printing, servo motor 258 moves the series of pallets an amount equal to the index length, or multiple thereof, and then stops the pallets at the print stations. After the completion of a printing cycle, the servo motor 258 again moves the series of pallets by a multiple of the index length.

Figure 29:
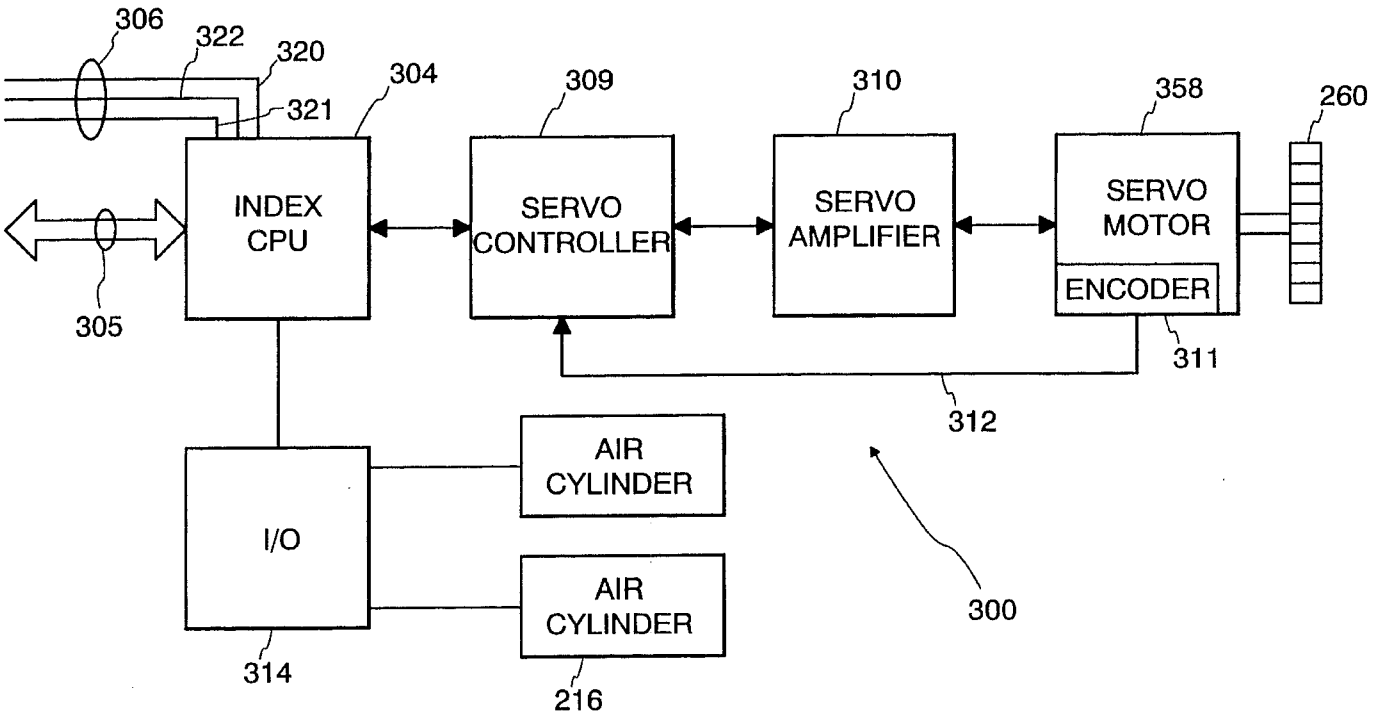
FIG. 29 is a block diagram of the index controller of FIG. 28.

FIG. 29 is a block diagram of the index controller 300 circuitry including the servo motor 258. FIG. 29 includes index CPU 304 which is connected to master controller 36 by busses 305 and 306. Bus 306 is used as described herein to control the sequence of printer operations. Bus 305 is used by index CPU 304 to receive and transmit data concerning machine operation.

Prior to the start of the first or next index operation, master controller 36 transmits to index CPU 304 a command specifying the operation it is to perform when the next logic high on start line 321 is received. The information comprises a command with a numerical designation. The command specifies that an index operation is to be performed and the numerical designation specifies the number of index lengths to be moved during the index operation. The numerical designation includes a sign portion to specify the direction of movement. A positive sign signifies clockwise movement while a negative sign signifies counterclockwise movement. For example, CPU 304 might receive a command from master controller 36 specifying an index operation for −3 index lengths. In response to this information, the pallets 12 should move 3 index lengths counterclockwise beginning at the next logic 1 start signal on start line 321.

Index controller 34 also includes a servo loop of known type comprising a programmable servo controller 309, a servo amplifier 310, the servo motor 258 with position encoder 311 and a feedback path 312 from encoder 311 to servo controller 309. Servo controller 309 is micro processor controlled and receives instructions from index CPU 304 to define its operation. Servo controller 309 is pre-programmed to control the speed of servo motor 258 as well as the desired acceleration to and deceleration from that speed. The encoder count number of encoder 311 which represents an index length is also pre-programmed into servo controller 309. Thus, the index CPU 304 need only identify to the servo controller 309, the number of index lengths to be moved and the direction of such movement. Thereafter, when the start signal is received by index CPU 304, the servo controller 309 is notified to begin and the servo motor 258 is controlled to rotate, thereby moving the chain and pallets 12 the specified number of index lengths in the specified direction.

When printing is to be performed it is important that the pallets be placed in registration at the print stations. To this end, each print station includes a registration air cylinder 216 which drives the pallet at that station into registration. Index controller 300 controls the operation of the air cylinders 216 by means of an input/output unit 314 which is controlled by index CPU 304. At the end of an index cycle, servo controller 309 notifies index CPU 304 when servo motor 258 has stopped rotation. In response to such notice, index CPU 304 transmits a command to input/output unit 314 to energize all registration air cylinders 216. After commanding registration air cylinders 216 to lock their respective pallets, index CPU 304 releases the busy line 322, which will then assume the logic high state.

During the interval that busy line 322 is being held low by index CPU 304, master controller 36 transits to each print station having an active print station controller, e.g. 34, 301, and which will receive an active pallets a command describing its action at the next logic high start signal. The message transmitted to all print stations which are to print at the next print interval is merely a notice that they should print. The specifics of the print operation are already stored in the respective print station controllers by arrangements discussed herein.

Figure 33:
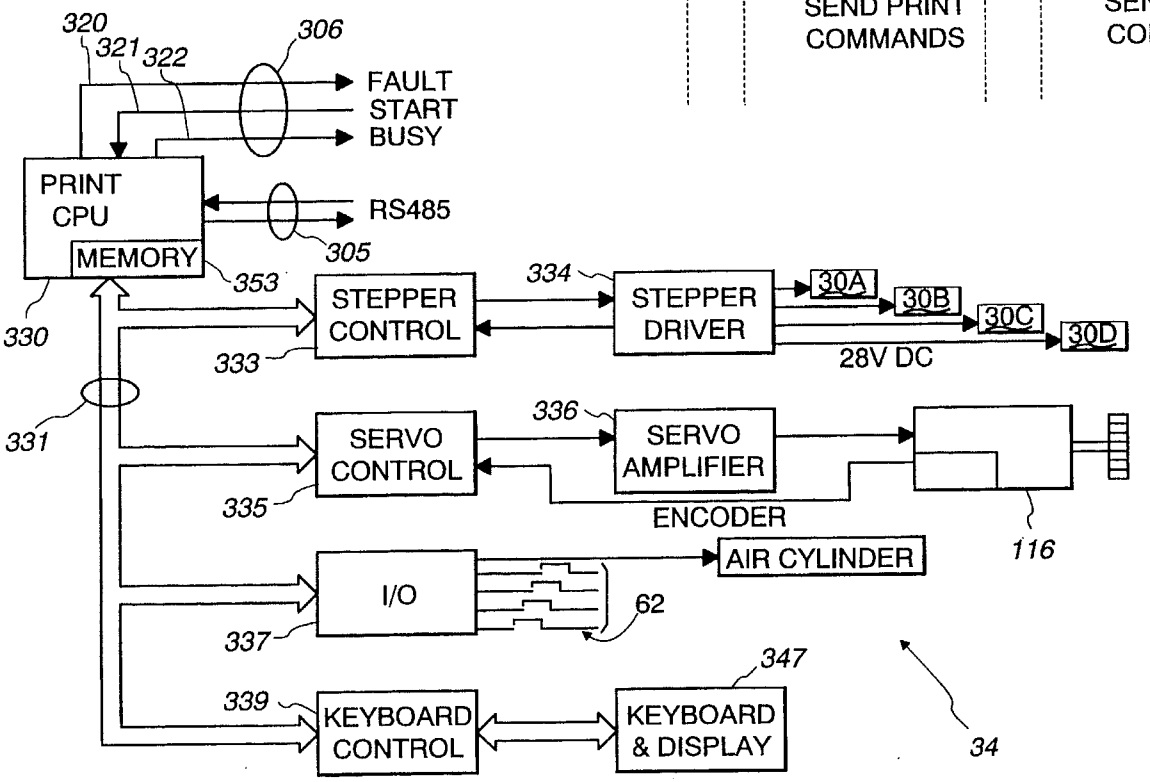
FIG. 33 is a block diagram of the print controller of FIG. 28.

FIG. 33 is a block diagram of a printer controller, e.g. 34, which includes a print CPU 330 and its peripheral input/output apparatus. Print CPU 330 is of the 8051 type with ancillary equipment, such as memory 353 and communication line interfaces, as is well known in the art. The input/output apparatus, which includes a stepper motor controller 333 with driver 334, a servo motor controller 335 and amplified 336, an input/output interface 337 and a keyboard display controller 339, is connected to print CPU 330 by a bus 331. Stepper controller 333 communicates with print CPU 330 to control four stepper motors 30A–30D, one of which is connected to each corner of print screen 24. Servo controller 335 is connected in a feedback loop of the known type to control a servo motor 116 to move a screen print carriage 20 comprising a flood bar 22 print squeegee 26 out and back over the print screen. Input/output controller 337 is used by print CPU 330 to control additional print apparatus such as air cylinders 17 and 19, which drive the flood bar 22 and print squeegee 26, respectively, down to the print screen. Input/output controller 337 is also used to read the limit switches 62A–D associated with the home positions of the stepper motors 30A–D.

Print CPU 330 stores in the memory 353 the distance moved by screen 24 for each movement code or pulse sent to stepper motors 30A–D. Accordingly the number of movement codes sent to stepper motor and the rate of sending such codes can be used to precisely control the rate of movement and position of print screen 24. Each position controllable stepper motor, e.g. 30A (FIG. 27), includes a limit switch 62 mounted to the base of the motor. When the screen 24 is at its top most position, called the home position, the limit switch 62 opens. The status of home position limit switches 62 is periodically read by print CPU 330 via the I/O interface 337. When any of the limit switches indicates an open circuit (home position) the sending of movement codes to the associated stepper motor is stopped. When all four switches 62A–D are open the screen 24 is in the home position.

Keyboard controller 339 interfaces a keyboard/display unit 347 with print CPU 330 in a manner well known in the art. The face of keyboard and display unit 347 is shown in FIG. 31. Before printing can be started, it is necessary to provide certain parameters to the individual print station controllers to describe their functions. Although the general nature of these parameters is substantially the same from print job to print job, their actual values vary depending on the substrate to be printed, the inks being used and the nature of the image being printed. The print station keyboard display unit 347 is used to select the needed parameters and to supply values for them.

As previously described, the printing mechanism consists of a print screen 24, which can be raised and lowered by four stepper motors 30A, 30B, 30C and 30D, and a print carriage 20, carrying a flood bar 22 and a squeegee 26, which is moved forward and back by a position controllable servo motor 116. In the present embodiment the front and back stop positions along the screen can be electronically set to allow print squeegee movement of a desired distance at a desired location. Further, the speed of the carriage 20 during flood bar and squeegee movement along the screen can be independently set. Additionally, the screen can be lowered to a desired position during a print cycle to provide a controlled spacing between the substrate and the screen when the pallets are being indexed and when printing is to occur.

The basic printing function of the print head comprises engaging the flood bar 22 with the printing ink on the print screen 24, moving the flood bar along the screen to distribute the ink, lowering the screen to an off-contact distance from the pallet, moving the print squeegee along the screen to impart ink to the substrate and raising the print screen to allow free movement of the pallet and substrate. In order to speed overall operation, the screen may be lowered to an approach distance above a possibly moving pallet before the screen is lowered to the off-contact distance when the pallet is known to be stopped. Further, it is possible with the preferred embodiment to perform multiple of the above print operations during one index stop of a pallet and substrate and to controllably peel the screen from the substrate.

To properly control the various printing operations, an operator interacts with the keyboard/display device 347 during a setup to enter desired control parameters into print CPU 330. To begin parameter setting, the printing machine is placed in the setup mode by pressing a mode key 391 at master controller 36. The master controller responds by entering a setup mode and advising each station of such controller over bus 305. The operator then begins to enter parameters at each active print head. When an operator enters a parameter at keyboard/display 347 and presses an OK button 351, the parameter is entered into a predetermined location in memory 353 (FIG. 33) of print CPU 330.

The flood stroke and print stroke can occur in selected lengths at selected positions over the print screen. For a print cycle the operator selects a back position to define one end of the flood and print area and a front position to select the other end of the flood and print area. A button 370 of the keyboard 347 is pressed by an operator and the print CPU 330 responds by displaying "back position" on a first line of a display 40 and displaying a current setting on a second line of the display. By pressing an up arrow or a down arrow of button 370, the operator can increase or decrease the back position from 1 to 36 inches in increments of 0.1 inch. When the proper back position is displayed, the operator presses the OK button 351 and the parameter is stored in memory of 353 at a location associated with the back position. The parameter locations in memory 353 are represented in FIG. 34. Should the operator not press the OK button 351, the back position parameter stored in memory 353 will not be changed.

Figure 26A:
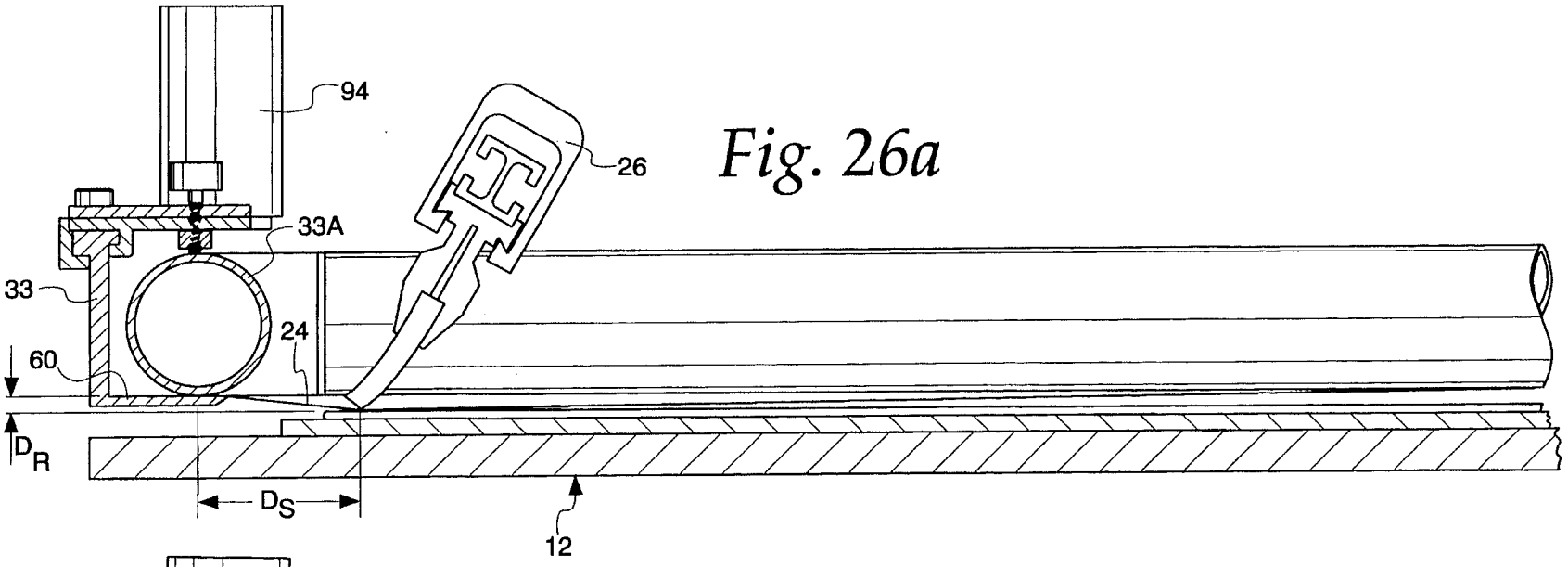
FIG. 26*a* is an enlarged, fragmentary view of a portion of printing screen, holder and squeegee at the beginning of a print stroke.

In a manner similar to that discussed above, the operator can set the front position in increments of 0.1 inch, the flood speed for 1 to 40 inches per second, the print speed for 1 to 40 inches per second and the off contact distance of 0 to 3 inches in increments of 0.01 inches. Each of these entered parameters is stored in an associated location of memory 353 upon pressing the OK button 351. The peel-off parameter can be set as above described in increments of 0.1° from 0° to 2°. Upon entry of the peel off angle by the operator, the print CPU 330 calculates the values for the time of starting to raise the front end of the print screen 24 and the rate at which the front of the screen should be raised. It should be noted that the front of the screen is first raised to achieve the desired peel-off angle depending on the position of the print squeegee. Then, the front continues to be raised at a rate determined in part by the print speed in order to maintain the peel-off angle. Peel off is described in greater detail with regard to FIGS. 39 and 26.

The print heads 18 of the preferred embodiment are also capable of performing multiple flood and print operations during each print cycle, each flood and print operation having different parameters. When a second flood and print operation is desired, the operator sets the parameters of the first operation as above described, then presses an F1 button 348 of the keyboard/display unit 347. Print CPU 330 responds to the F1 button 348 by entering a special character in a predetermined location 355 of memory 353 to denote a second print operation and then enters a second setup procedure. In the second setup procedure, all of the setup parameters are established as above described and stored in locations separate from the first setup parameters to be accessed for the control of the second print and flood control operation.

Master controller 36 is responsible for the synchronized operation of the printing apparatus 10 and includes a master CPU 360 which is of the 8051 type connected as shown in FIG. 35. Master CPU 360 is connected to buses 305 and 306 for communication with the print station controllers, e.g. 34, 301, and the index controller 300. Master CPU 360 includes a bus 363 which connects master CPU 360 to an input/output unit 364 and, via a keyboard/display controller 366, to a keyboard/display unit 367 as also shown in FIG. 30. Operator interaction with the keyboard/display unit 367 facilitates setup of the printing machine and defines control parameters for control of the machine.

Keyboard display unit 367 includes a field 368 combined indicator buttons. In FIG. 30, the field 368 represents an oval printing machine having 18 print stations, each having a group of four indicator buttons associated with it. The placement of the groups of buttons corresponds to the location of the associated print station around the oval. Four indicator buttons are associated with each print station 16 and comprise a T-shirt icon 369A, a setup button 369B, a print button 369C and an on/off button 369D. Each of the buttons 369 A–D is a push button for data entry and has light to indicate activity. The on/off button 369D, when illuminated indicates that the associated print station is active, which status can be changed by pressing on the button. The print button 369C, when pressed, begins a print cycle at the corresponding print station when the associated print station is active. The indicator light of button 369C will remain on during the print cycle. Pressing the setup button 369B causes the status of the station to be displayed on a display unit 361. The T-shirt icon 369A is used to indicate the status (empty/full) of the pallet at the associated station. Such status indication can be changed by pressing on the icon. The buttons 369A–D are only effective during a setup mode, however, the indications provided by the buttons are present in all modes. The current status of each of the indicator buttons is stored in a memory 362 of the master CPU 360 for use by master CPU in controlling the printing machine.

Keyboard display unit 367 also includes a field 380, which includes the LCD display 361 and other control and indicator devices. Pressing a start button 383 will start the presently active mode of operation by the machine. A stop button 385 is used to stop the machine after a present print cycle. Pressing a clear button 387 clears the indications provided by all of the T-shirt icons of field 368.

Keyboard display 367 also includes a mode button 391 and three associated indicator lights 391A, 391B, and 391C to indicate set up; test and print modes, respectively. The test mode permits test prints to be performed at the print stations, the print mode is the normal operational mode for a printing job and the set up mode allows the entry of operational parameters into memory 362 of master CPU 360 (FIG. 35).

The entry of parameters into the master controller is primarily a menu based function. When a menu key 392 is successively pressed, different menu categories are successively displayed on the LLD display 361. The menu categories identify which parameters are to be set. When menu button 392 is pressed while in the set up mode an index setup mode is entered and the words "index set-up" are displayed on the display 361. Pressing a down arrow button 398 in this mode displays index length on display 361 and permits the operator to enter either single or double index length by pressing the up 393 or down 398 arrow buttons. When the appropriate index length is entered an OK button 394 is pressed to store parameters in memory 362. Pallet skip, the next index set up menu item, can be entered by again pressing the menu button. Pallet skip permits the operator to select printing on every pallet or on every other pallet. Again the related value will be stored in memory 362 when the OK button 394 is pressed. The load and unload positions are also set in the index set up mode by pressing the up and down arrow keys to identify a load station and an unload station. Additionally, the index direction, i.e., direction of pallet movement, can be set by pressing the menu key until "Index Direction" is displayed on display 361 then selecting a direction with the up and down arrow key.

For some printing jobs extra wide, e.g., 54", pallets are used and the print stations have extra wide print screens. Due to the size of the extra large print screens and their associated print heads, only every other print station can be equipped. Similarly, due to the width of the pallets, only every other pallet can be loaded with a substrate. Some printing on the extra wide pallets may be done by normal sized print heads which can occupy adjacent print stations. In order to maximize the usefulness of the printing machine, it is desirable to index the pallets by one index length even though only every other pallet is being used. In this situation, single length indexing is requested but only every other pallet leaving the load station is marked active. The pallet skip feature is used so that only every other pallet leaving the load station is marked as active regardless of the index length selected.

Master controller 36 also accepts an operational parameter called dwell time to set the minimum time between successive index operations when in the automatic printing mode. When a dwell button 397 is pressed a time in seconds can be displayed on a display 399 and entered into the memory 362 of the master CPU 360. During automatic printing the index repetition rate is set by the sum of the operation times the index controller and the slowest print station. That is, if an index requires four seconds, and the slowest print requires five seconds, the index repetition rate is at least nine seconds. When a dwell time is set which is less than the index and print time sum, the index and print time sum will control the repetition rate. Alternatively, if the dwell time exceeds the index and print time sum then the dwell time controls the repetition rate.

Memory 362 also stores an indication of the active (in use) or inactive (not in use) status of each pallet. This stored status consists of a group of linked storage locations equal in number to the number of print stations each of which stores the status of an associated pallet. FIG. 36 represents at 396 the 18 storage locations of memory 362 used to track the pallet states. Whenever master CPU 360 sends an index command to index controller 300 master CPU reads the contents of storage locations 396, shifts the information so read by the number of index lengths and direction specified in the command, and rewrites the contents back into locations 396. In this manner the active/inactive state of each pallet is tracked as the pallets move around the oval. During the set up mode the contents of storage location 396 are changed whenever a T shirt icon is pressed. Also, during normal automatic printing, in the every pallet mode, each pallet leaving a load station after a stop there is marked active and each pallet stopping at an unload station is marked inactive. During normal automatic printing in the every other pallet mode (skip pallet) only every other pallet leaving an input station is marked active.

Figure 40:
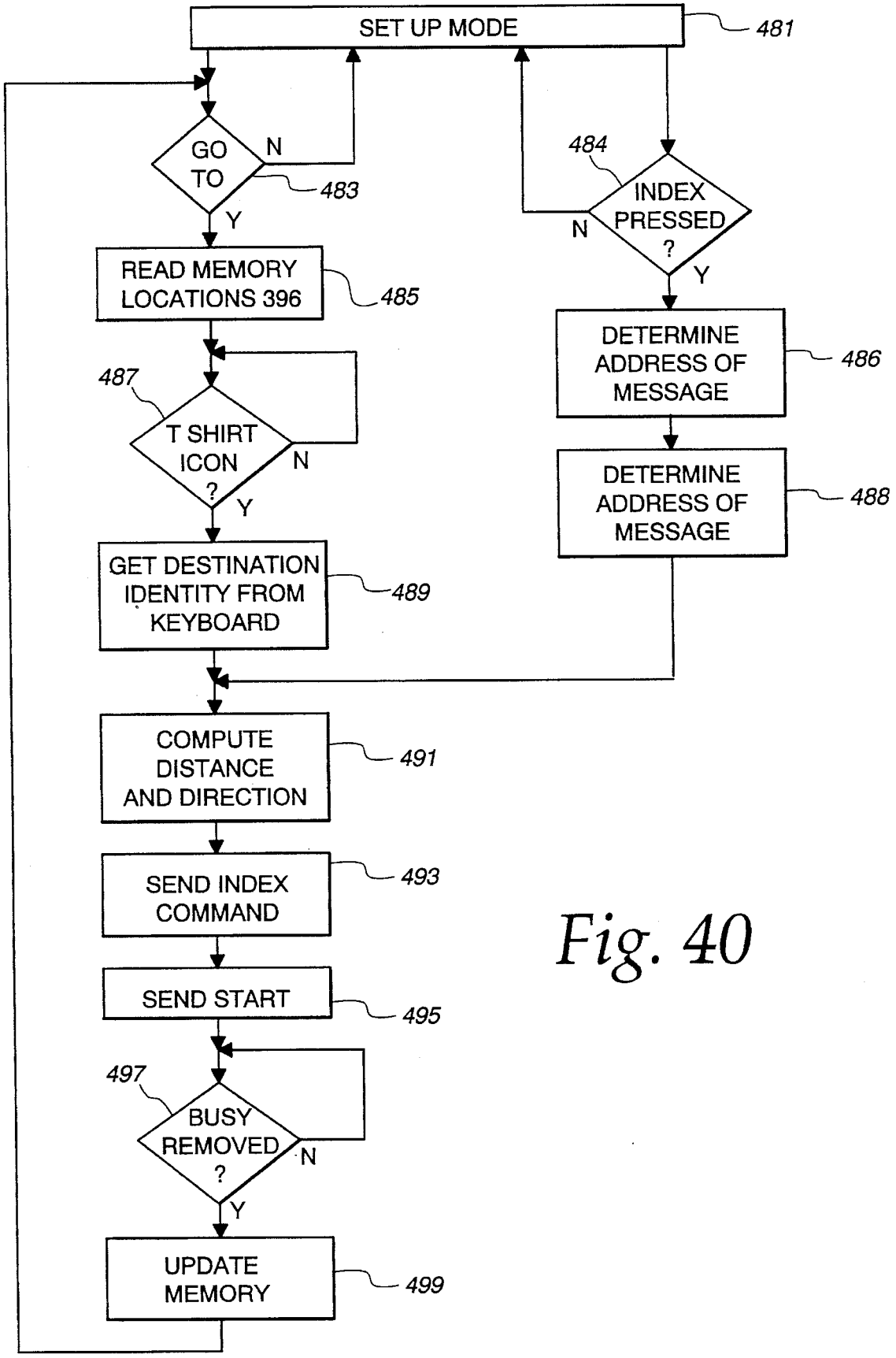
FIG. 40 is a flow diagram of operations by its master controller during set-up when implementing special set-up functions of "go to" and "follow me"

During set up of the printing machine it is often desirable to efficiently move pallets from one printing station to another printing station at locations perhaps several index lengths apart. The printing machine of preferred embodiment has two ways of achieving such efficient pallet movement. An operation called GOTO as represented in FIG. 40 can be invoked while printing machine is in set up mode. First, a selected T shirt icon button is pressed to indicate a start pallet which is desired to be moved to a destination position. By normal operation of the master controller 36, the start pallet will be marked active in the memory locations 396. The operator then presses a GOTO button 395. Master CPU 360 detects the press of the GOTO in a step 483 and identifies the start pallet by reading memory locations 396 in a step 485. Master CPU 360 then awaits the next T-shirt icon press in a step 487. The next T-shirt icon press will identify the destination print station. When the destination icon is pressed, master CPU 360 obtains its identity in step 487 and calculates in step 491 the shortest distance and direction, in index lengths, between the start pallet and destination print station. An index command specifying such movement is then sent to the index controller 300 and a start signal is sent on start line 321 (step 495). The index controller 300 responds to the command by moving the pallet at the marked start position to the marked destination print station. When the busy signal is removed by index CPU 304 and detected by master CPU 360 in step 497 the Master CPU updates memory location 396 to reflect the moment. Thereafter, the flow returns to await further actions.

A similar movement of pallets is achieved by cooperation between the master controller 36 and a print station controller, e.g., 34. This movement, called "follow me", is also active during the set up mode of the master controller and is represented in FIG. 40. "Follow me" begins by pressing any one of the T shirt icons, e.g., 369A at master controller 36, to indicate an active pallet at a given start print station. The identity of this active pallet will of course be stored in memory location 396 as described above. The operator then goes to any print station and presses an index button 398. When the index button is pressed the associated print CPU 330 transmits a message which identifies the print station location where the index button was pressed to master controller 36 over bus 305. This location is called the destination print station. Master controller 36 responds to the receipt of the index message in a step 484 by performing a step 486 in which memory locations 396 are read to identify the start pallet and by identifying the destination print station from the received message (step 488). The flow then continues to step 491 to determine the shortest distance and direction between the start location and destination location. Master controller 36 then transmits an index command to index controller 300 specifying this direction and the number of index lengths. A start signal is then transmitted on lead 321 and the index controller 300 responds by moving the pallet from the start location to the destination location without pauses. When the pallets stop moving the pallet at the destination continues to be marked active in locations 396 so that further "go to" or "follow me" movements can be made.

After the various parameters specifying a printing job have been entered into the memories of Master controller 36, and the print station controller, e.g., 34 and 301, an automatic printing process can begin. At the master control panel 367 a mode button 389 is pressed to enter the automatic mode and the print mode is selected by button 391. When the start button 383 is pressed master controller begins to transmit index commands, start signals, print commands and start signals as described previously.

Figure 37:
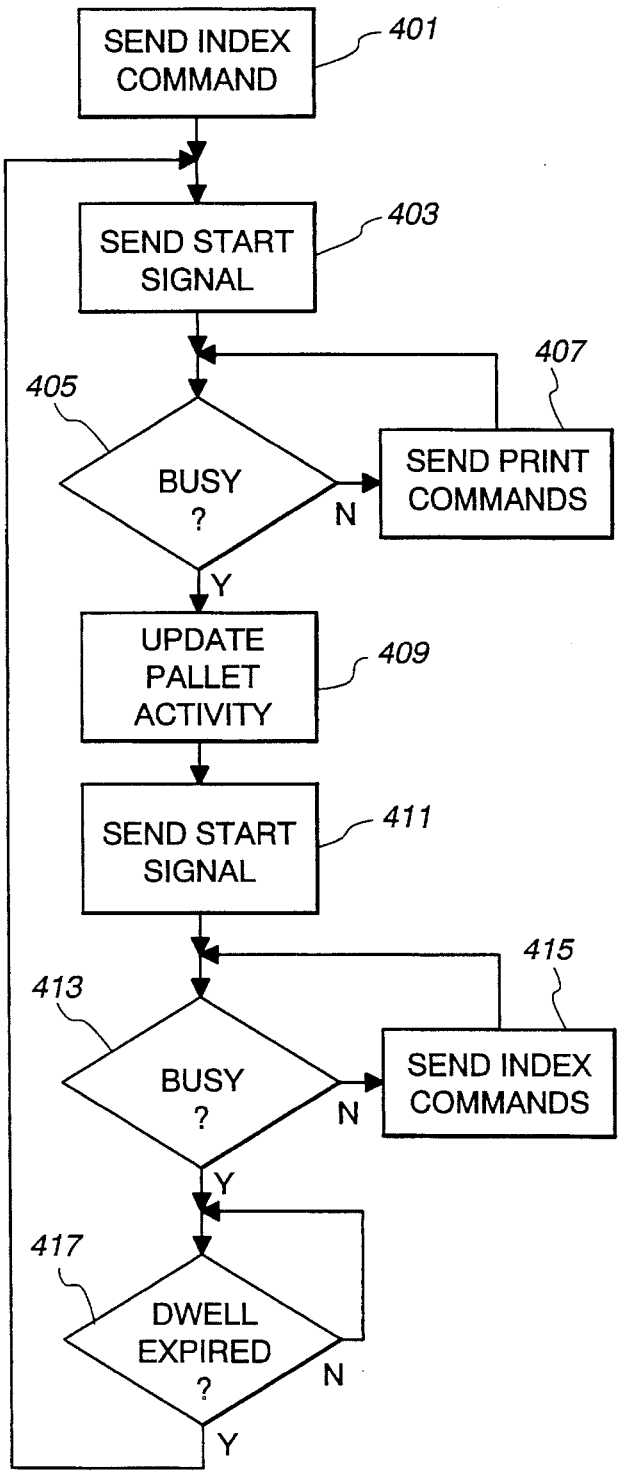
FIG. 37 is a flow diagram of normal automatic printing by the master controller.
Figure 38:
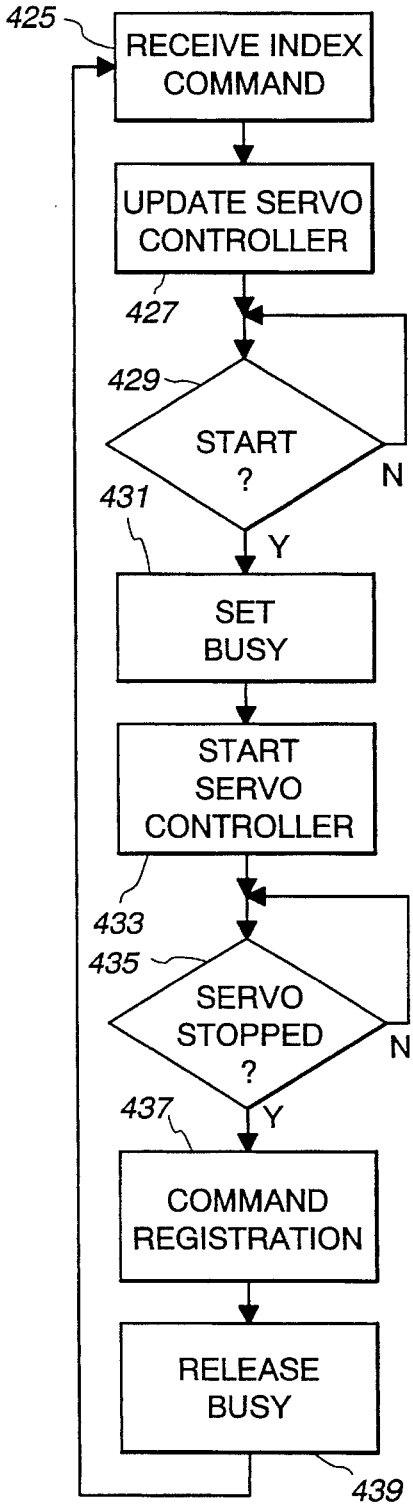
FIG. 38 is a flow diagram of normal automatic printing by the index controller.
Figure 39:
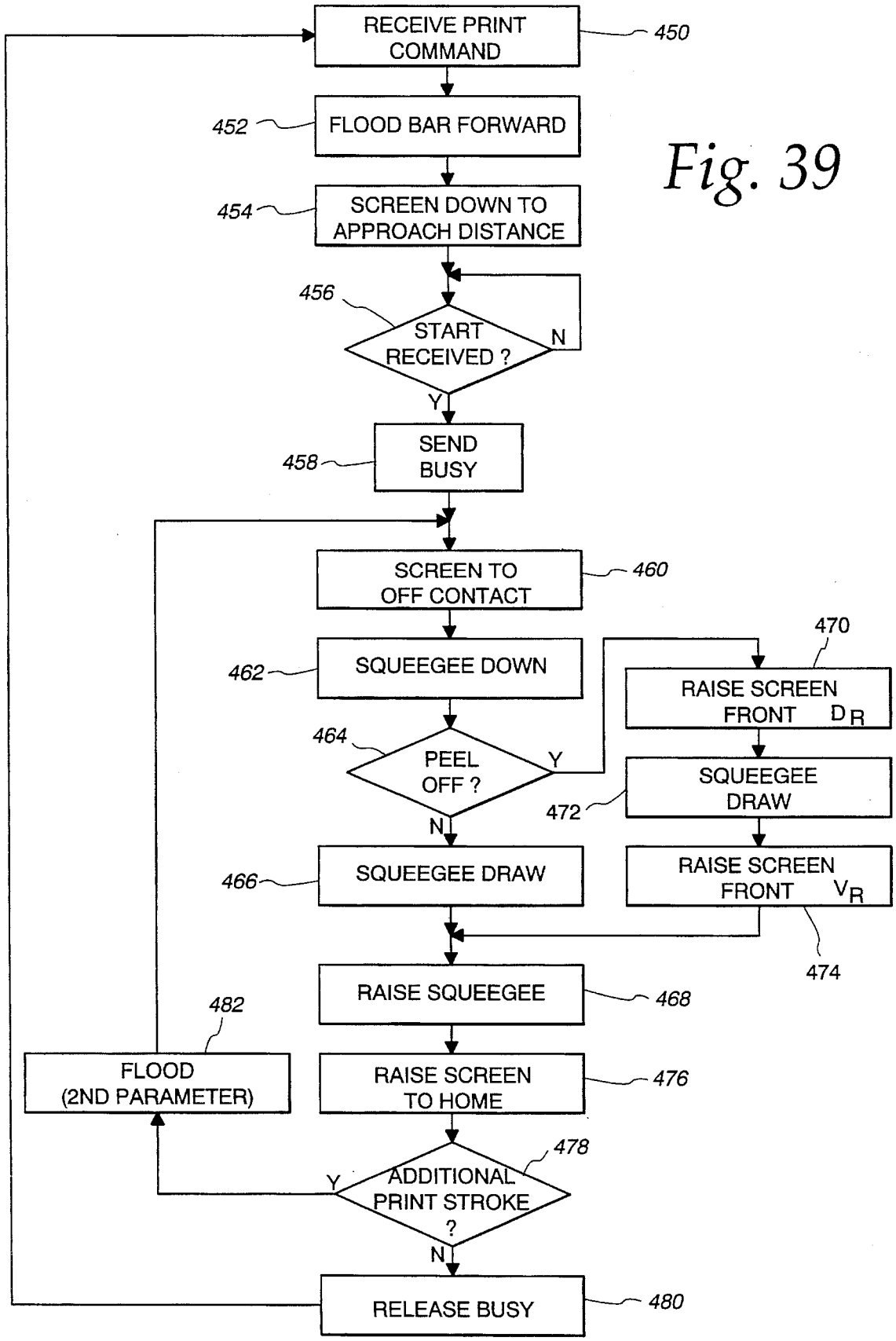
FIG. 39 is a flow diagram of normal automatic printing by its print controller.

FIGS. 37–39 comprise interactive flow diagrams of the operations of master controller 36, index controller 300 and print controller 34 in the completion of a normal automatic print operation. When the start button 383 of master controller/keyboard display 367 is pressed, master controller sends a command in step 401 over bus 305 specifying an index of one index length in the clockwise direction. This index could in fact be of any number of index lengths as preset during setup. After a short pause to permit the index controller 300 to react, master controller 36, in step 403, sends a start signal on start line 321 to all controllers. Since only the index controller has received an unexecuted command, only it will respond to the start signal. After sending the start signal, master controller 36 scans the busy line 322 to sense when the index controller 300 has completed the index operation as represented by decision block 405.

While awaiting the busy signal to be removed, master controller 36 sends print commands to all active print stations which will have active pallets at the completion of the index movement as is determined from memory locations 396. These print commands will be acted on at the next start signal. Upon detecting the removal of busy signal in decision block 405, the process proceeds to step 409 update locations 396 of memory 362 to represent the new pallet positions. In step 409, the value of the skip pallet parameter is checked so that a pallet leaving the load position is marked active when appropriate. Such an update of memory automatically updates the display on the T shirt icons in field 368.

Next, a second start signal is sent on start lead 321 in step 411. Only the print stations having received a print command respond to this second start command since the command previously sent to the index controller has already been executed. After sending the start signal in step 411, master controller 36 again surveys in step 413 the busy line 322 which will be marked busy by the print controllers. While the busy line is being watched, the next index command is transmitted to index controller 300 via the bus 105 in step 415. When the busy lead 322 again indicates idle, master controller 36 proceeds to a step 417 where a pause is inserted, if needed, so that the index cycle will not repeat until the preset dwell time has expired. When the dwell time has expired, and the print controllers have released the busy line, the process proceeds to step 403, where another start signal is sent on start line 321. Only the index controller will respond to this last start signal, since only it has received an unexecuted command. The processing loop of FIG. 37 continues until printing is stopped by, for example, pressing the stop button 385 of master keyboard display 367.

FIG. 38 represents the process performed by the index controller in response to signals from master controller 36. In a step 425 index controller 300 receives a command specifying a number of index lengths and a direction for movement. Index CPU 304 responds to the command in a step 427 by updating servo controller 309 to identify the commanded actions. Index controller 300 then awaits, in a step 429, the arrival of a start signal from master controller 36. When the start signal is received, the index CPU 304 sends, in step 431, a busy signal on busy lead 322 and sends a command, in step 423, to servo controller 309. Servo controller 309 responds to the command by controlling the rotation of servo motor 308 to move the pallets the distance and direction specified in the index command from master controller 36. Index CPU 304 then waits in a step 435 for a signal from servo controller 309 indicating that the prescribed movement is complete. When the servo motor 308 has stopped, index controller 300 sends a command in step 437 to energize the registration air cylinders 316 to all print stations. Thereafter, the busy signal is released in step 439 and the process proceeds to step 425 to await a new index command.

FIG. 39 shows the sequence of operations by a print station controller, e.g., 34 during a printing cycle. Such operations begin in a step 450 with the receipt of a print command from master controller 36. In order to reduce the total print and index cycle time, some operations are started at the print station before receipt of a start signal. Only initial functions which do not require contact with a substrate are performed before the start signal is received. Upon receipt of the print command, the servo motor 116 is directed by print CPU 330 to move the flood bar 22 forward to flood the print screen in a step 452. Next (step 454) the print CPU 330 directs stopper motors 30A–D to lower the print screen to an approach distance above platen and substrate. In a preferred embodiment, the approach distance is preset to be three inches, but alternative embodiments may enable print CPU 330 to use an operator settable approach distance which would depend on the thickness of the substrate. After achieving this approach distance, the print controller awaits the start signal in a step 456.

When the start signal is received the print CPU 330 sends a busy signal on busy lead 322 in step 458 and controls all stepper motors 30A–D to move the screen down to the preestablished off contact distance in a step 460. When multiple print strokes are used, the first exercise of step 460 will move the screen to the first off contact distance set by the operator. When the screen has stopped, the air cylinder 19 controlling the squeegee 26 is activated in step 462 to drive the print squeegee 26 down to print screen 24. In a step 464, it is determined whether a peel off angle was set by the operator. When no peel off angle was set (0°) the print CPU 330 directs servo motor 116 to draw the print squeegee 26 at the pre-established rate back to start position in a step 466 and to raise the squeegee by releasing the squeegee air cylinder in step 468.

Figure 26B:
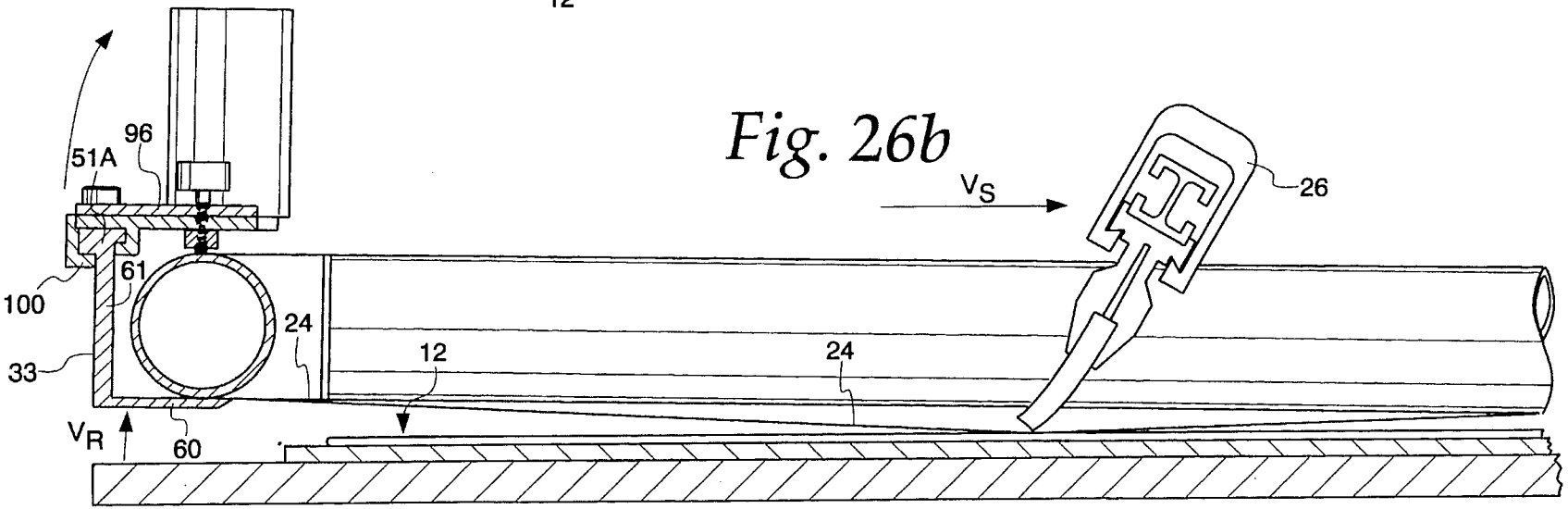
FIG. 26*b* is a view similar to FIG. 26*a* showing the peeling of the screen from a substrate on a pallet.

Alternately, when step 464 identifies that a non-zero peel off has been set, print CPU 330 proceeds to a step 470, where stepper motors 30A and 30B are directed to raise the front of the print screen 24. The amount of such raise is determined by the squeegee distance from the front edge of the screen called $D_S$ in FIG. 26*a*, and the peel off angle. The distance of the raise ($D_R$, FIG. 26*a*) in step 470 is equal to the tangent of the specified peel off angle times the distance $D_S$ between the front of the print screen 24 and the squeegee 26. After the screen front is raised, print CPU 330 directs servo motor 116 in a step 472 to draw the squeegee along the screen at the preset rate. This is shown in FIG. 26*b*. Beginning at the same time as the step 472, a step 474 is performed to raise the front of the screen to maintain the peel off angle at the preset amount. The rate of screen movement $V_R$ is controlled by print CPU 330 to equal the preset rate of squeegee movement $V_S$ times the tangent of the peel off angle. The raising of the screen front in step 474 continues as long as the squeegee is drawn in step 472. When the squeegee movement stops, it is raised in step 468 by the release of air cylinder 19.

After the squeegee is raised in step 468, its print CPU 330 directs in a step 476 all four stepper motors 30A–D to raise the screen to the home position. In a step 478, the print CPU 330 identifies from the preset parameters stored in memory 353, whether a second print stroke is to occur. When no such second print stroke is needed, the process continues to step 480, in which the busy line 322 is released and back to step 450 to await a subsequent print command. When a second print stroke is needed, the process continues from step 478 to step 482, where the flood bar 22 is commanded to flood in accordance with the second preset parameters, and the process proceeds to step 460 to repeat the printing process. During the second pass through steps 460 to 476, the parameters established for the second print stroke are used to control the process. It should be noted that when multiple print strokes are performed, the busy signal is not released until the last stroke is complete.

As will be appreciated by those in the screen printing arts, the setting of the variables for indexing and printing is a daunting task. The present embodiment provides many capabilities which reduce the burden of setting up a printing job and also to provide a system which can electronically record and reuse the set up parameters at a later time. As seen in FIG. 28, the electrical control system is in fact a network of function specific micro processors. When a print job is implemented each micro processor has stored in memory the necessary parameters to control its portion of the job. In order to process those parameters, master controller 36 includes a job record function. This function is entered by pressing an F1 key 307 when the printing machine is stopped in the print mode. When job record is enabled the master CPU 360 individually interrogates each print CPU, e.g., 330, and the index CPU 304 over bus 305. Each remote CPU responds to this interrogation by reading the job related parameters stored in the respective CPU memories and transmitting the information so read to master controller 36. The CPU 360 of master controller 36 then stores the print job parameters in its memory 362 in separated locations for later recall. Master controller 36 also includes a bulk storage device 365, such as a floppy disk drive, which is connected to master CPU 360 via bus 363. The print job parameters accumulated and stored in master CPU 360 can be written from master CPU memory 362 into the media of the bulk storage unit 365 for a long term storage. Also, a diskette storing print job parameters can be read by master CPU 360 and stored in memory 362. An automatic job set up can then be performed by master controller 36. In the automatic set up master CPU 360 reads the separately stored parameters from its memory 362 and transmits those parameters to the print controllers and index controller. Each print and index controller responds to a job set up message addressed to it by storing parameters received in the operational locations of its memory such as in shown in FIG. 34.

In the preceding description print heads are described as being placed at selected print stations and interactively controlled with an indexer by the master controller 36. Other adjuncts, such as a flash cure unit may also be installed at selected print stations and cooperate with the interactive control for completion of print cycles.

FIG. 41 shows an intelligent flash cure unit 501 for use with printing machine 10. Flash cure unit 501 can be inserted into a print station such as 16C which is not equipped with a print head and an overhang 503 having a quartz lamp heating assembly 505 is leveled above the pallet registration areas. Flash cure until 501 includes a flash cure controller 507, as shown in FIG. 42, which includes a flash cure CPU 509 of the 8051 type. Flash cure CPU 509 is connected to data bus 305 and control bus 306 as are the other CPU's of the machine.

FIG. 43 represents the surface of overhang 503 which is exposed to substrates for curing thereof. The individual lamps 511 of flash cure assembly 505 are shown in dotted line in FIG. 43. The heating assembly 503 includes an infrared sensor 513 which views downwardly toward the substrate to "read" the temperature of the substrate. The assembly is wired to separately energize three zones of bulbs as shown labeled 515, 517 and 519. The use of infrared sensor 513 and zones of lamps 515–519 are discussed below.

FIG. 44 shows a keyboard/display panel 521 of the flash cure until 501. Three push buttons 523, 525 and 527 are present on the keyboard/display panel 521 and each controls a respective one of lamp zones 515, 817 and 519. When a given button is pressed, e.g., 523, the lamp zone, e.g., 515, will be enabled during flash cure operations. The use of push buttons 523–527 allows energy and cost savings when curing substrates which are smaller than the entire surface of the assembly 503.

Keyboard/display 521 is interfaced to flash cure CPU 509 via a keyboard controller 529 for the reading of input data and the display of information on a display panel 539. The status of several input devices of panel 521 are used to control the operation of the flash cure unit 501. Panel 521 includes an address switch which is used to set the address of the print station in which the flash cure until is installed. The set address is communicated to the flash cure CPU 509 and on to the master controller 36 via bus 305 so that master controller will know how to access the flash cure unit. In addition, the panel 521 includes a manual override switch 545 to convert the unit to manual operation and an on/off switch 541. Display 539 is used to display the preset temperature to be achieved by the flash cure unit 501. The temperature is adjusted by pressing a push button 551 while pressing on up button 547 or a down button 549. When the proper temperature parameter is displayed, the buttons are released and the temperature will be stored in memory 531 of flash cure CPU 509.

The master control panel 367 is used to set one of three modes for flash cure operation. As discussed above, menu button 392 is pressed until the menu level for flash cure adjustment is reached. At the menu level pressing the up and down arrow keys will cause the temperature sensitive mode O, the fast mode 1 or the fixed power mode 2 to be displayed on display 361. Pressing the OK button 394 will cause the identity of the displayed mode to be stored. In the temperature sensitive mode, the temperature is caused to rise gradually so as not to overshoot the preset cure temperature. In the fast mode, the temperature is caused to rise rapidly and some temperature overshoot may occur. In the fixed power mode, the preset cure temperature will be held for a set amount of time. The actual implementation details defining the flash cure modes is pre-stored in memory 531 of the flash cure controller.

During printing the master controller sends a flash command to the flash cure unit 501 when print commands are being sent to the print stations. The command directs that a flash cure operation is to occur at the next start signal and the mode of the operation. The flash cure then becomes active at the next start signal and, like the print controller, marks busy line 322 busy. Accordingly, should the flash cure until 501 be the slowest unit during the print cycle, its time of operation will set the overall print cycle time.

In a flash cure operation, flash cure CPU 509 energizes the heater lamps 505 via input/output until 533 and a heating interface 537. The flash cure CPU 509 then continues to survey the temperature sensed by sensor 535 until the set temperature is reached in accordance with the command mode. When the temperature is reached (and the hold time if in the fixed power mode) the heater is stopped and the busy signal is removed from busy line 322.

What is claimed is:

1. A screen printer having a plurality of printing stations for making successive screen prints on a substrate, the combination comprising:

a screen printing frame;

a pallet for carrying the substrate between the printing stations;

an endless drive on the screen printing frame for carrying the pallet through the print stations;

a pallet support connected to the endless drive and carrying the pallet through the printing stations, the pallet support being stationary during a registration operation;

a screen printing head mounted on the screen printing frame at each of said plurality of printing stations for printing on the substrate on the pallet;

at least one movable locator on the screen frame at the printing stations for shifting the pallet on and relative to the pallet support to register the pallet with respect to the printing head.

2. A screen printer in accordance with claim 1 wherein an interlock locks the pallet to the pallet support for travel between printing stations.

3. A screen printer in accordance with claim 2 wherein the interlock comprises abutting surfaces on the pallet and pallet support; and a spring biases the abutting surfaces to interlock with one another.

4. A screen printer in accordance with claim 3 wherein:

a motor forces the locator against the pallet with a greater force than the force exerted by the spring to disengage the abutting surfaces to allow the pallet to float and shift relative to the support, which is stationary during the registering operation.

5. A screen printer in accordance with claim 3 including a release power operator for movement to engage the pallet and to overcome the force exerted by the spring to shift the pallet to unlock the abutting surfaces to allow removal of the pallet from the pallet support.

6. A screen printer in accordance with claim 1 wherein a fixed locator is mounted on the screen frame and is spaced from the pallet until a registration operation at which the fixed locator engages an adjacent end of the pallet while the movable locator engages an opposite end of the pallet and shifts the pallet to engage the adjacent end with the fixed locator.

7. A screen printer in accordance with claim 6 wherein a locator notch is provided on the pallet adjacent the movable locator, and another locator notch is provided on the pallet adjacent the fixed locator.

8. A screen printer in accordance with claim 1 wherein:

inner and outer support surfaces on the screen frame support the pallet support; and inner and outer rollers are provided on the pallet support for rolling along the inner and outer support surfaces to support the weight of the support and to provide a rolling friction carrying of the pallet support, pallet and substrate.

* * * * *